US007647015B2

(12) United States Patent
Kubota et al.

(10) Patent No.: US 7,647,015 B2
(45) Date of Patent: Jan. 12, 2010

(54) COLOR IMAGE FORMING APPARATUS AND COLOR IMAGE FORMING METHOD

(75) Inventors: Kousuke Kubota, Saitama (JP); Noribumi Sato, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 210 days.

(21) Appl. No.: 12/004,065

(22) Filed: Dec. 20, 2007

(65) Prior Publication Data

US 2008/0292335 A1 Nov. 27, 2008

(30) Foreign Application Priority Data

Mar. 30, 2007 (JP) ..... 2007-094538

(51) Int. Cl.
*G03G 15/01* (2006.01)

(52) U.S. Cl. ..... 399/301

(58) Field of Classification Search ..... 399/49, 399/67, 68, 297, 298, 299, 301, 302, 303
See application file for complete search history.

(56) References Cited

U.S. PATENT DOCUMENTS

| | | | | |
|---|---|---|---|---|
| 6,198,896 | B1 * | 3/2001 | Nakayasu et al. | 399/301 |
| 6,941,083 | B1 * | 9/2005 | Muratani | 399/49 |
| 7,239,833 | B2 * | 7/2007 | Tomita et al. | 399/299 |
| 7,376,375 | B2 * | 5/2008 | Kobayashi et al. | 399/301 |
| 7,509,082 | B2 * | 3/2009 | Goto | 399/301 |
| 7,551,867 | B2 * | 6/2009 | Yamanaka et al. | 399/53 |
| 2006/0127119 | A1 | 6/2006 | Sato | |

FOREIGN PATENT DOCUMENTS

| | | |
|---|---|---|
| JP | A-10-104909 | 4/1998 |
| JP | A-2002-014506 | 1/2002 |
| JP | A-2003-098769 | 4/2003 |
| JP | A-2003-167409 | 6/2003 |
| JP | A-2003-177581 | 6/2003 |
| JP | A-2005-024616 | 1/2005 |
| JP | A-2005-062468 | 3/2005 |
| JP | A-2006-146065 | 6/2006 |
| JP | A-2006-171237 | 6/2006 |

* cited by examiner

*Primary Examiner*—Hoan H Tran
(74) *Attorney, Agent, or Firm*—Oliff & Berridge, PLC

(57) ABSTRACT

A color image forming apparatus includes a color-shift-detection-image forming unit, a color shift detector, a recording-material color-shift correcting unit and a conveyance-unit color-shift correcting unit. The color-shift-detection-image forming unit selectively forms a color-shift detection image on a recording medium or a first conveyance unit. The color shift detector detects color shift based on the color-shift detection image. The recording-material color-shift correcting unit performs color-shift correction based on the color-shift detection information corresponding to the color shift on the recording medium. The conveyance-unit color-shift correcting unit performs color-shift correction based on an amount of change in the color-shift detection information corresponding to the color shift on the first conveyance unit. The amount of change is determined using the color-shift detection information corresponding to the color shift on the first conveyance unit, which is obtained after the recording-medium color-shift correcting unit performs the color-shift correction, as a reference.

12 Claims, 29 Drawing Sheets

(a) FIRST COLOR-SHIFT CORRECTION (b) SECOND COLOR-SHIFT CORRECTION (a) RELATIONSHIP AMONG BEAMS OF EXPOSING UNIT CORRESPONDING TO RESPECTIVE COLORS (b) IMAGE FORMATION TIMINGS BEFORE COLOR-SHIFT CORRECTION IN MAIN SCANNING DIRECTION IS PERFORMED (c) IMAGE FORMATION TIMINGS AFTER COLOR-SHIFT CORRECTION IN MAIN SCANNING DIRECTION IS PERFORMED

CORRECTION IN MAIN SCANNING DIRECTION

CORRECTION IN SUB-SCANNING DIRECTION

COLOR IMAGE FORMING APPARATUS AND COLOR IMAGE FORMING METHOD

CROSS-REFERENCE TO RELATED APPLICATIONS

This application is based on and claims priority under 35 U.S.C. §119 from Japanese Patent Application No. 2007-94538 filed Mar. 30, 2007.

BACKGROUND

1. Technical Field

The invention relates to a color image forming apparatus and a color image forming method.

2. Related Art

Some of color image forming apparatuses include plural image forming units and an image transfer belt that conveys a sheet so that the sheet faces the image forming units. Color-component images formed by the respective image forming units are sequentially transferred onto the sheet.

SUMMARY

According to an aspect of the invention, a color image forming apparatus includes a plurality of image forming units, a first conveyance unit, a color-shift-detection-image forming unit, a color shift detector, a recording-medium color-shift correcting unit and a conveyance-unit color-shift correcting unit. The image forming units form a plurality of color-component images. The first conveyance unit conveys a recording medium to locations corresponding to the respective image forming units. The color-shift-detection-image forming unit selectively forms a color-shift detection image on the recording medium or the first conveyance unit. The color shift detector detects color shift based on the color-shift detection image, which is selectively formed on the recording medium or the first conveyance unit by the color-shift-detection-image forming unit. The recording-medium color-shift correcting unit performs color-shift correction based on color-shift detection information corresponding to the color shift on the recording medium. The conveyance-unit color-shift correcting unit performs color-shift correction based on an amount of change in the color-shift detection information corresponding to the color shift on the first conveyance unit. The amount of change is determined using the color-shift detection information corresponding to the color shift on the first conveyance unit, which is obtained after the recording-medium color-shift correcting unit performs the color-shift correction, as a reference.

BRIEF DESCRIPTION OF THE DRAWINGS

Exemplary embodiments of the invention will be described in detail below with reference to the accompanying drawings, wherein.

DETAILED DESCRIPTION

Firstly, summary of exemplary embodiments of the invention will be briefly described.

Summary of Exemplary Embodiments

Figure 1:
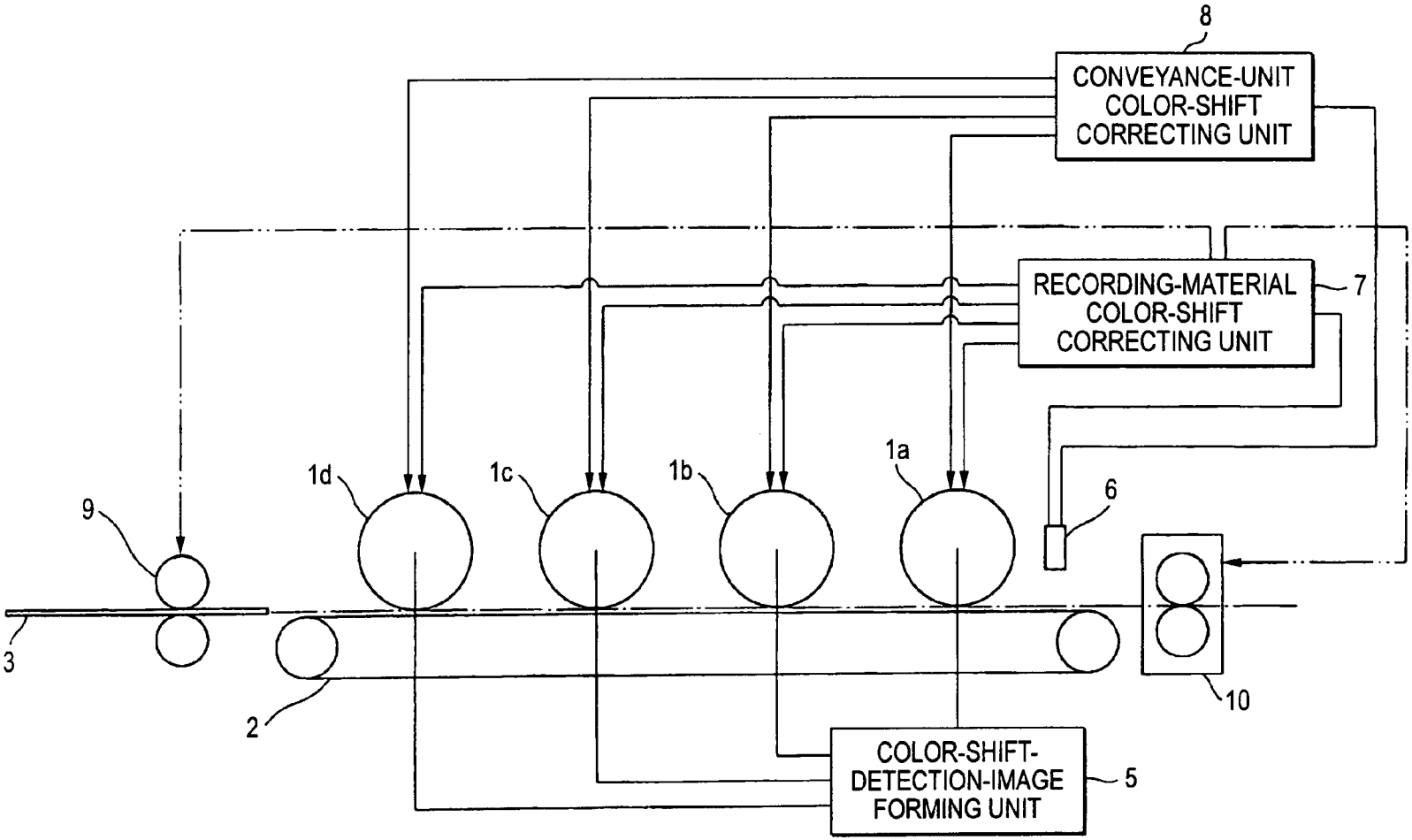
FIG. 1 is an explanatory drawing which schematically illustrates a color image forming apparatus according an exemplary embodiment of the invention.

FIG. 1 schematically shows a color image forming apparatus according to an exemplary embodiment of the invention. In the figure, the color image forming apparatus includes plural image forming units 1 (for example, 1*a* to 1*d*) that form plural color-component images and a first conveyance unit 2 that conveys a recording material 3 to locations corresponding to the respective image forming units 1. The color image forming apparatus further includes a color-shift-detection-image forming unit 5, a color shift detector 6, a recording-material color-shift correcting unit 7 and a conveyance-unit color-shift correcting unit 8. The color-shift-detection-image forming unit 5 selectively forms a color-shift detection image TG (see FIG. 2) on the recording material 3 or the first conveyance unit 2. The color shift detector 6 detects color shift based on the color-shift detection image TG, which is selectively formed on the recording material 3 or the first conveyance unit 2 by the color-shift-detection-image forming unit 5, to generate color-shift detection information. The recording-material color-shift correcting unit 7 performs color-shift correction based on the color-shift detection information corresponding to the color shift on the recording material. The conveyance-unit color-shift correcting unit 8 performs color-shift correction based on an amount of change in the color-shift detection information corresponding to the color shift on the first conveyance unit 2. The amount of change is determined using the color-shift detection information corresponding to the color shift on the recording material 3, which is obtained after the recording-material color-shift correcting unit performs the color-shift correction, as a reference.

Although the recording-material conveyance belt 2 is of a belt type in FIG. 1, it may be of a drum type.

In addition, the color-shift-detection-image forming unit 5 has any configuration so long as it causes the image forming units 1 to selectively form the color-shift detection image TG on the recording material 3 or the first conveyance unit 2. Normally, such a configuration is adopted that the color-shift-detection-image forming unit 5 forms the color-shift detection image TG by using the respective image forming units 1.

Furthermore, the color shift detector 6 has any configuration so long as it detects color shift based on the color-shift detection image TG formed on the recording material 3 or the first conveyance unit 2. A single detector may detect both the color-shift detection images TG formed on the recording material 3 and the first conveyance unit 2. Alternatively, one detector for detecting the image TG formed on the recording material 3 and another detector for detecting the image TG on formed on the first conveyance unit 2 may be provided separately. In addition, the number of the color shift detector(s) 6 for detecting the color-shift detection image(s) TG is not limited to one, but may be plural.

Also, the recording-material color-shift correcting unit 7 has any configuration so long as it performs the color-shift correction based on the color-shift detection information corresponding to the color shift on the recording material 3. Also, the conveyance-unit color-shift correcting unit 8 has any configuration so long as it performs the color-shift correction based on the amount of change in the color-shift detection information corresponding to the color shift on the first conveyance unit 2. Here, the amount of change is determined using, as a reference, the color-shift detection information corresponding to the color shift on the recording material 3, which is obtained after the recording-material color-shift correcting unit 7 performs the color-shift correction.

Followings are representative modes of the recording-material color-shift correcting unit and the conveyance-unit color-shift correcting unit 8.

In a first form, the color-shift correction is performed by correcting image-formation start timings of the respective image forming units 1. Specifically, the recording-material color-shift correcting unit 7 corrects the image-formation start timings of the respective image forming units 1 based on the color-shift detection information corresponding to the color shift on the recording material 3, to perform the color-shift correction, and the conveyance-unit color-shift correcting unit 8 corrects the image-formation start timings of the respective image forming units 1 based on the amount of change in the color-shift detection information corresponding to the color shift on the first conveyance unit 2, to perform the color-shift correction. Here, the amount of change is determined using, as a reference, the color-shift detection information corresponding to the color shift on the recording material 3, which is obtained after the recording-material color-shift correcting unit 7 performs the color-shift correction.

In a second form, the color-shift correction is performed by correcting output timings of the respective image forming units by converting image information. Specifically, the recording-material color-shift correcting unit 7 corrects the output timings of the image forming units 1 by correcting the image information based on the color-shift detection information corresponding to the color shift on the recording material 3, to perform the color-shift correction, and the conveyance-unit color-shift correcting unit 8 corrects the output timings of the respective image forming units 1 by converting the image information based on the amount of change in the color-shift detection information corresponding to the color shift on the first conveyance unit 2, to perform the color-shift correction. Here, the amount of change is determined using, as a reference, the color-shift detection information corresponding to the color shift on the recording material 3, which is obtained after the recording-material color-shift correcting unit 7 performs the color-shift correction.

In a third form, the color-shift correction is performed by correcting a conveyance speed of the recording material 3 and (i) correcting image-formation start timings of the respective image forming units 1 or (ii) correcting output timings of the respective image forming units by converting image information. Specifically, the recording-material color-shift correcting unit 7 corrects the conveyance speed of the recording material 3 based on the color-shift detection information corresponding to the color shift on the recording material 3, to perform the color-shift correction. Also, to perform the color-shift correction, the conveyance-unit color-shift correcting unit 8 (i) corrects image-formation start timings of the respective image forming units 1 based on the amount of change in the color-shift detection information corresponding to the color shift on the first conveyance unit 2 or (ii) output timings of the respective image forming units 1 by converting image information based on the amount of change in the color-shift detection information corresponding to the color shift on the first conveyance unit 2. Here, the amount of change is determined using, as a reference, the color-shift detection information corresponding to the color shift on the recording material 3, which is obtained after the recording-material color-shift correcting unit 7 performs the color-shift correction.

The following configuration is conceivable as a representative mode of the recording-material color-shift correcting unit 7 that corrects the conveyance speed of the recording material 3. That is, the recording-material color-shift correcting unit 7 may correct the conveyance speed of the recording material 3 conveyed by a conveyance member 9 disposed on an upstream side of the first conveyance unit 2 in a recording-material conveyance direction or may correct the conveyance speed of the recording material 3 conveyed by a fixing device 10 disposed on a downstream side of the first conveyance unit 2 in the recording-material conveyance direction In a fourth form, the color-shift correction is performed by correcting a mechanical adjustment amount of at least one of the first conveyance unit 2 and a second conveyance unit (9, 10). Specifically, the second conveyance unit (9, 10) that conveys the recording material is provided. The second conveyance unit (9, 10) is different from the first conveyance unit 2. The recording-material color-shift correcting unit 7 corrects the mechanical adjustment amount of the at least one of the first conveyance unit 2 and the second conveyance unit (9, 10) based on the color-shift detection information corresponding to the color shift on the recording material 3, to perform the color-shift correction. Also, the conveyance-unit color-shift correcting unit 8 corrects the mechanical adjustment amount of the at least one of the first conveyance unit 2 and the second conveyance unit (9, 10) based on the amount of change in the color-shift detection information corresponding to the color shift on the first conveyance unit 2, to perform the color-shift correction.

Here, the second conveyance unit has a function of conveying the recording material 3 and may include either of the conveyance member 9 or the fixing device 10 or both.

Also, the mechanical adjustment amount of the at least one of the first conveyance unit 2 and the second conveyance unit (9, 10) may include (1) a setting angle of the first conveyance unit 2, (2) a mounting angle of the conveyance member 9 and/or the fixing device 10 relative to the recording-material conveyance unit 2, and/or (3) a contact pressure between a pair of rolls as an example of the conveyance member 9.

For example, in a mode in which the color-shift correction is performed by only adjusting the setting angle of the first conveyance unit 2, the recording-material color-shift correcting unit 7 corrects the setting angle of the first conveyance unit 2 based on the color-shift detection information corresponding to the color shift on the recording material 3 detected by the color shift detector 6 to perform the color-shift correction. Also, the conveyance-unit color-shift correcting unit 8 corrects the setting angle of the first conveyance unit 2 based on the amount of change in the color-shift detection information corresponding to the color shift on the first conveyance unit 2 to perform the color-shift correction. Here, the amount of change is determined using, as a reference, the color-shift detection information corresponding to the color shift on the recording material 3, which is obtained after the recording-material color-shift correcting unit 7 performs the color-shift correction.

In this mode, the recording-material color-shift correcting unit 7 and the conveyance-unit color-shift correcting unit 8 may have the same correction target as described above or may be configured to correct different correction targets.

In addition, as another mode, for example, at least one of the recording-material color-shift correcting unit 7 and the conveyance-unit color-shift correcting unit 8 according to any of the first to third modes may correct the mechanical adjustment amount of the at least one of the first conveyance unit 2 and the second conveyance unit of the fourth mode.

Additionally, from the viewpoint of performing the color-shift correction more finely in the recording material 3, the recording-material color-shift correcting unit 7 and the conveyance-unit color-shift correcting unit 8 may perform the color-shift correction according to according to a position in the recording material 3 where the color-shift detection information is detected.

Also, from the viewpoint of maintaining an accuracy of the color-shift correction at a good level, the color-shift detector 6 may detect a fixed image that has passed through the fixing device 10 disposed on a downstream side of the first conveyance unit 2 in a recording-material conveyance direction, to generate the color-shift detection information. Also, the recording-material color-shift correcting unit 7 may perform the color-shift correction based on the color-shift detection information.

Furthermore, as a timing at which the color-shift correction is performed, the conveyance-unit color-shift correcting unit 8 may perform the color-shift correction according to a condition under which a use environment is changed largely. Here, the condition under which the use environment is changed largely may include temperature information and/or information indicates whether or not parts are replaced.

In addition, as the timing at which the color-shift correction is performed, from the viewpoint of performing the color-shift correction more accurately, both of the recording-material color-shift correcting unit 7 and the conveyance-unit color-shift correcting unit 8 may be configured to perform the color-shift correction according to a condition under which the use environment is changed largely.

Furthermore, from the viewpoint of suppressing a color consumption of recording materials 3 for the color-shift correction to a minimum level, the recording-material color-shift correcting unit 7 may perform the color-shift correction at an initial stage, and the conveyance-unit color-shift correcting unit may perform second and subsequent color-shift corrections using a result of the color-shift correction performed by the recording-material color-shift correcting unit 7.

Next, correction of the color shift on the recording material 3 performed by the recording-material color-shift correcting unit 7 and correction of the color shift on the first conveyance unit 2 performed by the conveyance-unit color-shift correcting unit 8 according to this exemplary embodiment will be described.

—Correction of Color Shift on Recording Material—

Figure 2:
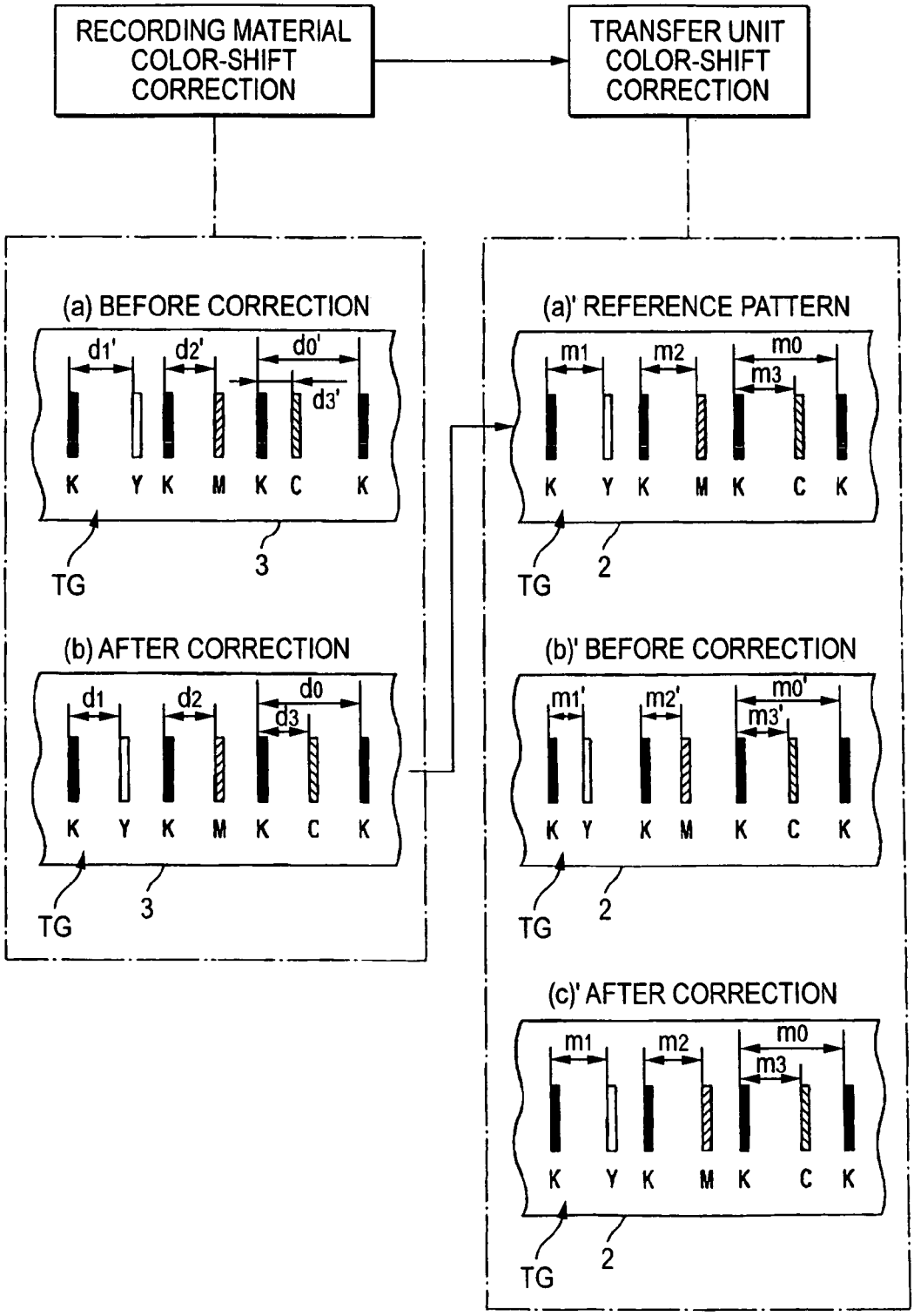
FIG. 2 is an explanatory drawing which illustrates an operation process of color-shift correction according to the exemplary embodiment shown in FIG. 1.

In a state before correction is performed as shown in FIG. 2(*a*), color-shift detection images TG are formed on the recording material 3 by the respective image forming units 1.

The color-shift detection images TG are such that linear color-shift detection images (hereinafter, referred to as "linear patches") of the respective color components of, for example, black (K), yellow (Y), magenta (M) and cyan (C) are formed at predetermined intervals with black (K) being used as a reference. It is assumed that pitches between the respective linear patches on the recording material 3 are $d_1'$ (pitch between K and Y), $d_2'$ (pitch between K and M), $d_3'$ (pitch between K and C), and $d_0'$ (pitch between K and K).

In this state, the color shift detector 6 detects the color-shift detection images TG, and the recording-material color-shift correcting unit 7 performs the color-shift correction so as to cancel color-shift amounts relative to the reference color of the respective colors and to set a standard array (pattern) in which the pitches between the linear patches of the respective colors become specified values $d_1$, $d_2$, $d_3$ and $d_0$, respectively as shown in FIG. 2(*b*) (after correction). In this case, $d_1$, $d_2$ and $d_3$ may be made to be identical to each other or may be set differently, while $d_0$ is selected appropriately in accordance with the relation between $d_0$ and the other specified values.

—Correction of Color Shift on Transfer Unit—

Color-shift detection images TG are formed on the first conveyance unit 2 after the color shift on the recording material 3 is corrected as described above as shown in FIG. 2(*a*)'. The color-shift detection images TG, which are at different pitches ($d_1 \rightarrow m_1$, $d_2 \rightarrow m_2$, $d_3 \rightarrow m_3$, $d_0 \rightarrow m_0$) from those on the recording material 3, are formed as a reference pattern on the first conveyance unit 2. This difference is based on the fact that when the recording material 3 is passed over from the conveyance member 9 to the first conveyance unit 2 and when the recording material 3 is passed over from the first conveyance unit 2 to the fixing device 10, the behavior of the recording material 3 during conveyance is changed due to a difference in speed between the two members between the recording material 3 is passed over.

Thereafter, if color-shift detection images TG are formed on the first conveyance unit 2 at a predetermined timing, it is assumed that color shift occurs. In this case, in a state before correction shown in FIG. 2(*b*)', the color-shift detection images TG have pitches different from the reference pattern shown in FIG. 2(*a*)'.

At this time, the conveyance-unit color-shift correcting unit 8 performs color-shift correction so that the pitches become the specified values ($m_1$, $m_2$, $m_3$, $m_0$) of the reference pattern.

It is assumed that the color-shift correction is performed on the first conveyance unit 2 in this manner. In this case, in a situation where the recording material 3 is being conveyed on the first conveyance unit 2, this color-shift correction corresponds to that the color-shift detection images TG are formed in the reference pattern in which the pitches are the specified values ($d_1$, $d_2$, $d_3$ and $d_0$). Therefore, it can be understood that the color-shift correction on the recording material 3 is also indirectly performed.

Hereinafter, other exemplary embodiments of the invention will be described in greater detail with reference to the accompanying drawings.

Exemplary Embodiment 1

Figure 3:
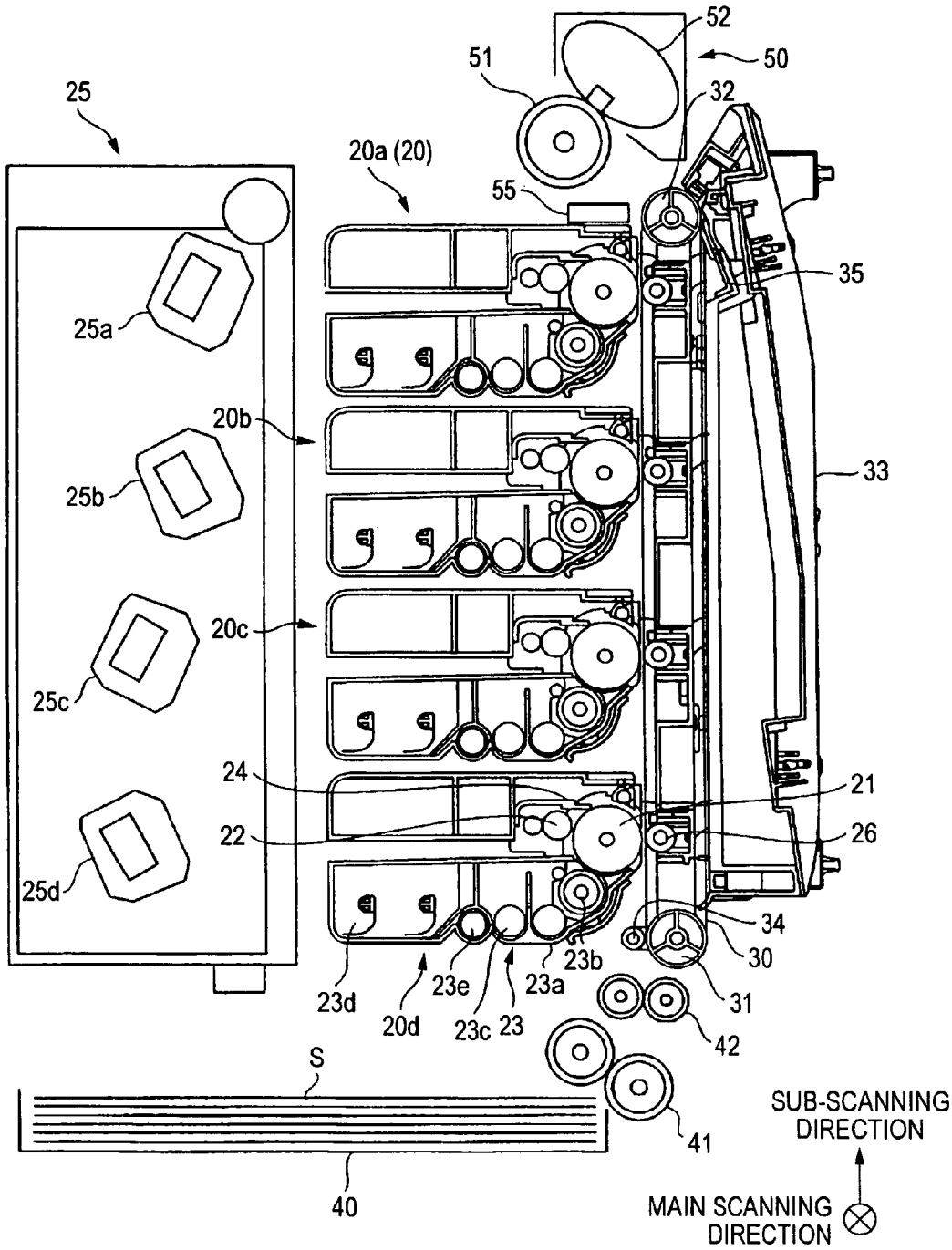
FIG. 3 is an explanatory drawing which schematically illustrates a color image forming apparatus according to an exemplary embodiment 1.

FIG. 3 is an explanatory drawing which shows an overall configuration of a color image forming apparatus according to the exemplary embodiment 1.

In the figure, the color image forming apparatus includes plural image forming units 20 (for example, 20*a* to 20*d*) which are disposed along, for example, a vertical direction and which form plural color-component images, and a recording-material conveyance belt 30 which is provided to face the respective image forming units 20 and which conveys a recording material S thereon.

The plural image forming units 20 form color-component images of, for example, black (K), cyan (C), magenta (M) and yellow (Y) by means of the electrophotographic process. Each of the image forming units 20 has a photoreceptor drum 21 which rotates in a predetermined direction and has a charger 22, a development unit 23 and a cleaner 24 around the photoreceptor drum 21. The charger 22 such as a charging roller charges the photoreceptor drum 21. The development unit 23 visualizes an electrostatic latent image formed on the photoreceptor drum 21 with a developer of a predetermined color. the cleaner 24 cleans substances remaining on the photoreceptor drum 21.

In particular, in this exemplary embodiment, each image forming unit 20 has a cartridge configuration in which the photoreceptor drum 21, the charger 22, the development unit 23 and the cleaner 24 are integrated. Each image forming unit 20 is detachably mounted in a predetermined location in a housing of the image forming apparatus. In addition, the development unit 23 adopts, for example, a two-component developing system which uses a two-component developer containing toner and carrier. A development roller 23*b* and a developer stirring member 23*c* are provided in a developer container 23*a* that houses the developer. A toner replenishment container 23*d* that houses replenishment toner is provided in a location adjacent to the developer container 23*a*. The toner in the toner replenishment container 23*d* is replenished, as required, to the developer container 23*a* via a toner transport member 23*e*.

In addition, in this exemplary embodiment, an exposing unit 25 such as a laser scanning unit is provided on an opposite side of the respective image forming units 20 to the recording-material conveyance belt 30. This exposing unit 25 is common to the respective image forming units 20 and has light emitting portions 25*a* to 25*d* for the respective color components which correspond to the respective image forming units 20 (20*a* to 20*d*). The light emitting portions 25*a* to 25*d* emit color-component light beams which correspond to the respective image forming units 20 by way of a deflection mirror, a focusing lens and the like which are not shown.

Furthermore, the recording-material conveyance belt 30 is stretched between, for example, tension rollers 31, 32. The recording-material conveyance belt 30 moves circularly so as to be able to convey the recording material S from a lower side to an upper side with the tension roller 32 made to function as a drive roller and the tension roller 31 made to function as a driven or follower roller.

In addition, this recording-material conveyance belt 30 is provided on an opening-and-closing-door side. The opening and closing door 33 is lateral to the housing of the image forming apparatus (not shown). The recording-material conveyance belt 30 is movable in conjunction with opening and closing operations of the opening and closing door 33.

Furthermore, in this exemplary embodiment, the recording-material conveyance belt 30 employs, for example, a belt material (for example, polyurethane rubber, polyimide resin and the like) made of a rubber or a resin which has a surface resistivity of $10^4$ to $10^8$ Ω/□. In addition, an attraction roller 34 as an attracting member is provided in a recording material receiving location, corresponding to the tension roller 31, of the recording-material conveyance belt 30. A predetermined attracting bias is applied to the attraction roller 34 so as to electrostatically attract a recording material S.

Furthermore, a belt cleaner 35 is provided in a location, corresponding to the tension roller 32, on the recording-material conveyance belt 30 so as to be contactable to and separatable from the recording-material conveyance belt 30. The belt cleaner 35 cleans a residual substance on the recording-material conveyance belt 30, such as color-shift detection images and residual paper dust.

Furthermore, transfer units 26 such as transfer rollers are provided on a back side of the recording-material conveyance belt 30 which faces the respective image forming units 20. A predetermined transfer bias is applied to the transfer units 26 to thereby transfer images on the photoreceptor drums 21 onto the recoding material S.

In addition, a charge eliminator (not shown) is provided at a part of the recording-material conveyance belt 30, so as to appropriately eliminate changes from the recording-material conveyance belt 30 which is charged by the attraction roller 34 and the transfer devices 26.

In addition, a recording-material container 40 that accommodates recording materials S is provided below the image forming units 20. A feed roller 41 is provided on a recording-material feeding side of the recording-material container 40, and a positioning roller (a registration roller) 42 is provided between the feed roller 41 and the recording-material conveyance belt 30. The positioning roller 42 positions a leading end of a recording material S and then feeds the recording material S to the recording-material conveyance belt 30.

Furthermore, a fixing device 50 for fixing images onto the recording material S is provided on a downstream side of the recording-material conveyance belt 30. In this exemplary embodiment, the fixing device 50 includes a fixing roller 51 which is heated by a heat source and a fixing belt 52 which is brought into press contact with this fixing roller 51 to follow the move of the fixing roller 51.

Furthermore, a color shift detector 55 is provided in a location corresponding to a position on a recording-material conveyance surface of the recording-material conveyance belt 30 on a downstream side of the most-downstream image forming unit 20*a*. This color shift detector 55 detects a color-shift detection image, which will be described later, formed on a recording material S or the recording-material conveyance belt 30. Specifically, the color shift detector 55 detects a level of reflection light caused by emitting light to the recording material S or the recording-material conveyance belt 30 and also detects a state of the color-shift detection image.

Figure 4:
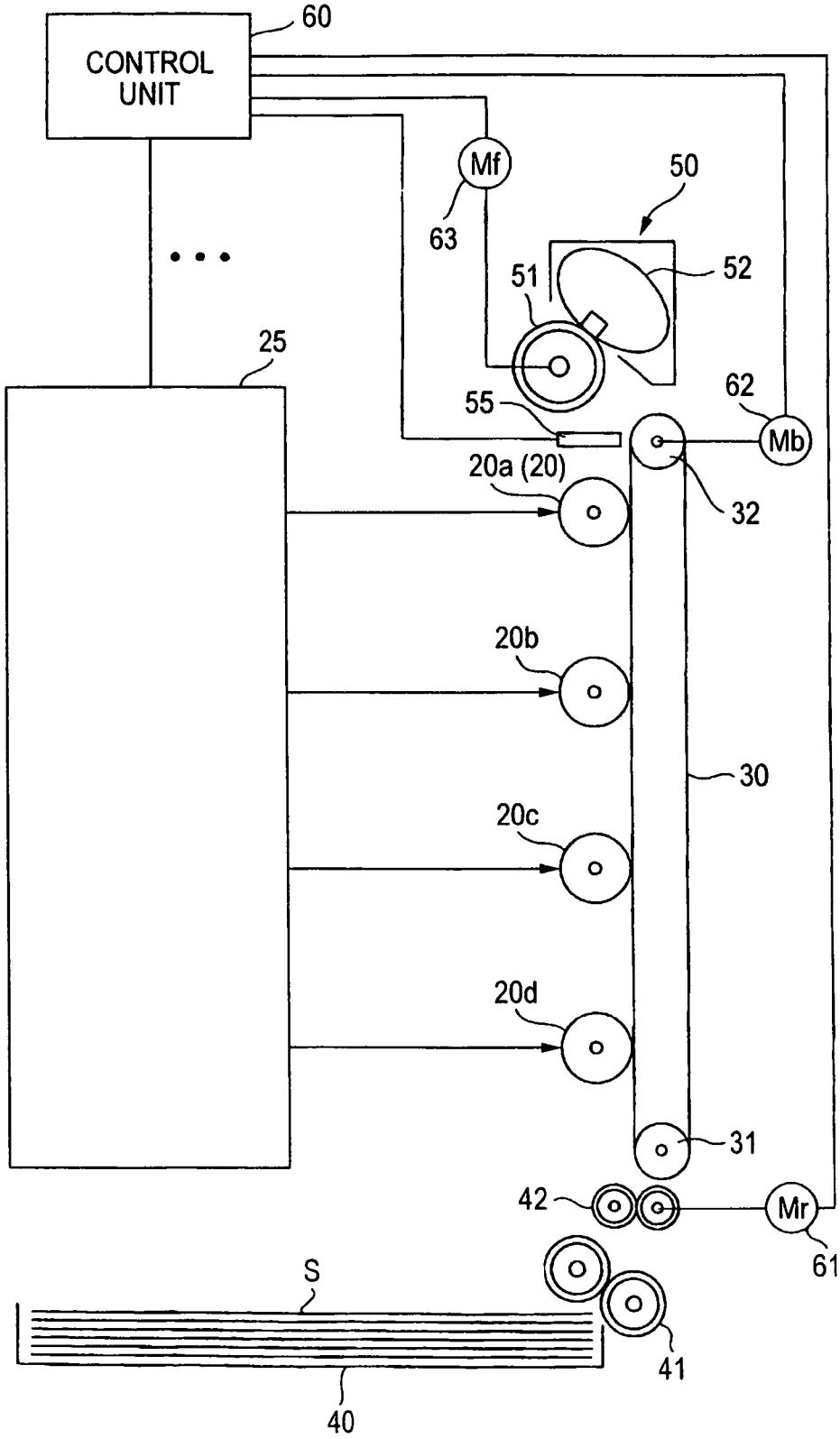
FIG. 4 is an explanatory drawing which illustrates a drive control system of the color image forming apparatus according to the exemplary embodiment 1.

In this exemplary embodiment, FIG. 4 shows a control system of the color image forming apparatus.

In the figure, reference numeral 60 denotes a control unit for executing an image formation process and a color-shift correction process, and is configured by, for example, a microcomputer.

This control unit 60 receives signals that are input from an operation unit (not shown) and various detectors (a recording-material position detector, a temperature detector and the like) including the color shift detector 55 and then executes an image formation process program and a color-shift correction process program (see FIGS. 5 to 7) which are stored in advance in a storage unit. The control unit 60 sends control signals to various types image forming devices such as the exposing units 25 and sends predetermined control signals to drive motors 61 to 63 (which are denoted by Mr, Mb, Mf in the figure) which are drive sources of the registration roller 42, the recording-material conveyance belt 30 and the fixing roller 51 of the fixing device 50 to control a conveyance speed of a recording material S conveyed by the registration roller 42, the recording-material conveyance belt 30 and the fixing device 50 to a predetermined speed.

Next, the operation of the color image forming apparatus according to this exemplary embodiment will be described.

—Image Formation Process—

In FIG. 3, when the operation unit (not shown) is operated to input a predetermined image formation command, the respective image forming units 20 (20*a* to 20*d*) forms electrostatic latent images, which correspond to the respective color components, on the photoreceptor drum 21 and thereafter the latent images are visualized with corresponding developers.

On the other hand, a recording material S is fed from the recording-material container 40 to the feed roller 41 at a predetermined timing, is positioned by the registration roller 42 and is then conveyed to the recording-material conveyance belt 30. The recording material S is attracted to the recording-material conveyance belt 30 by the attraction roller 34 for conveyance.

In this state, the respective color-component images on the photoreceptor drums 21 of the respective image forming units 20 are sequentially transferred onto the recording material S on the recording-material conveyance belt 30 via the transfer units 26. The recording material S onto which the respective color-component images have been transferred is then separated from a downstream end of the recording-material conveyance belt 30 and is conveyed to the fixing device 50. After the fixing device 50 heats and pressurizes the non-fixed image, the recording material S is eventually discharged to a recording-material discharge tray (not shown).

—Color-shift Correction Process—

Figure 5:
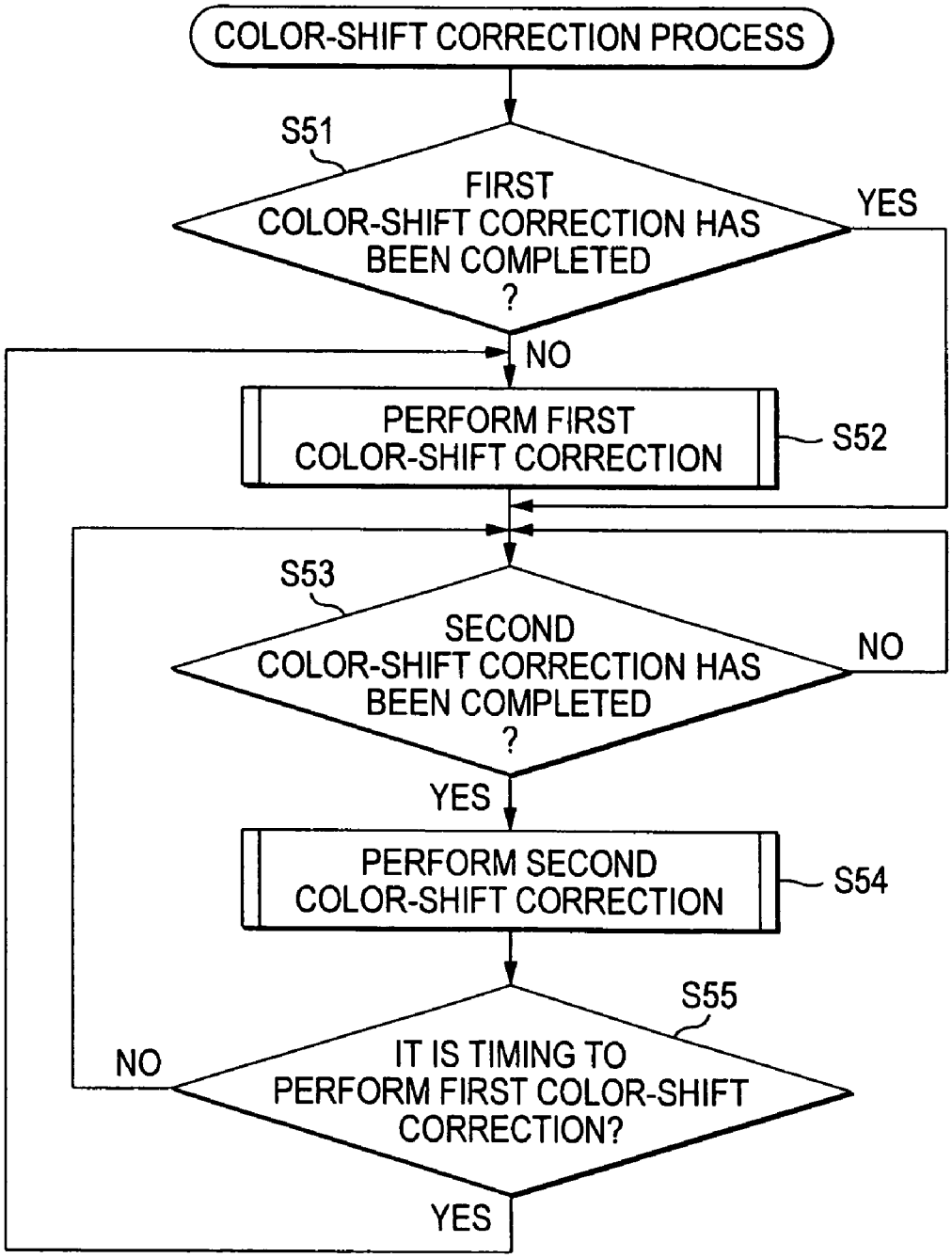
FIG. 5 is a flowchart which illustrates a color-shift correction process of the color image forming apparatus according to the exemplary embodiment 1.

In addition, in this exemplary embodiment, the control unit 60 performs a color-shift correction process as shown in FIG. 5.

In the figure, firstly, the color-shift correction process checks as to whether or not a first color-shift correction has been completed (S51). If it has not been completed yet, the first color-shift correction is performed immediately (S52). Whereas, if the first color-shift correction has been completed, then the process proceeds to step S53. Thereafter, the process checks as to whether or not a timing at which a second color-shift correction is to be performed comes (S53). If the timing at which the second color-shift correction is to be performed comes, then the second color-shift correction is performed (S54). After the second color-shift correction has been completed, the process checks as to whether or not a timing at which the first color-shift correction is to be performed comes (S55). Then, the process waits for performing of the first color-shift correction or the second color-shift correction.

In particular, in this exemplary embodiment, the color-shift correction process includes the step to check "whether or not the first color-shift correction has been completed?" (S51). This is intended to implement such a scheme that the first color-shift correction is performed in an initial stage such as when a color image forming apparatus is shipped from the factory and the second color-shift correction is performed for the second and subsequent times after the shipment in principle, and the first color-shift correction is performed again under a special condition.

Here, the "timing at which the second color-shift correction is to be performed" may be selected appropriately. For example, the second color-shift correction may be performed periodically each time the number of recording materials S on which images are formed reaches a specified number (for example, 100 to 300 sheets) or the second color-shift correction may be performed on condition that the use environment of the color image forming apparatus is changed (for example, temperature in the use environment changes more than predetermined degrees, humidity in the use environment changes more than predetermined degrees, or parts of the color image forming apparatus are replaced).

In addition, the "timing at which the first color-shift correction is to be performed" may be set so that the first color-shift correction is not performed after the first color-shift correction is performed for the first time unless a user requests. Alternatively, the first color-shift correction may be performed together with the second color-shift correction, for example, on condition that the use environment of the color image forming apparatus is changed.

—First Color-Shift Correction Process—

Figure 6:
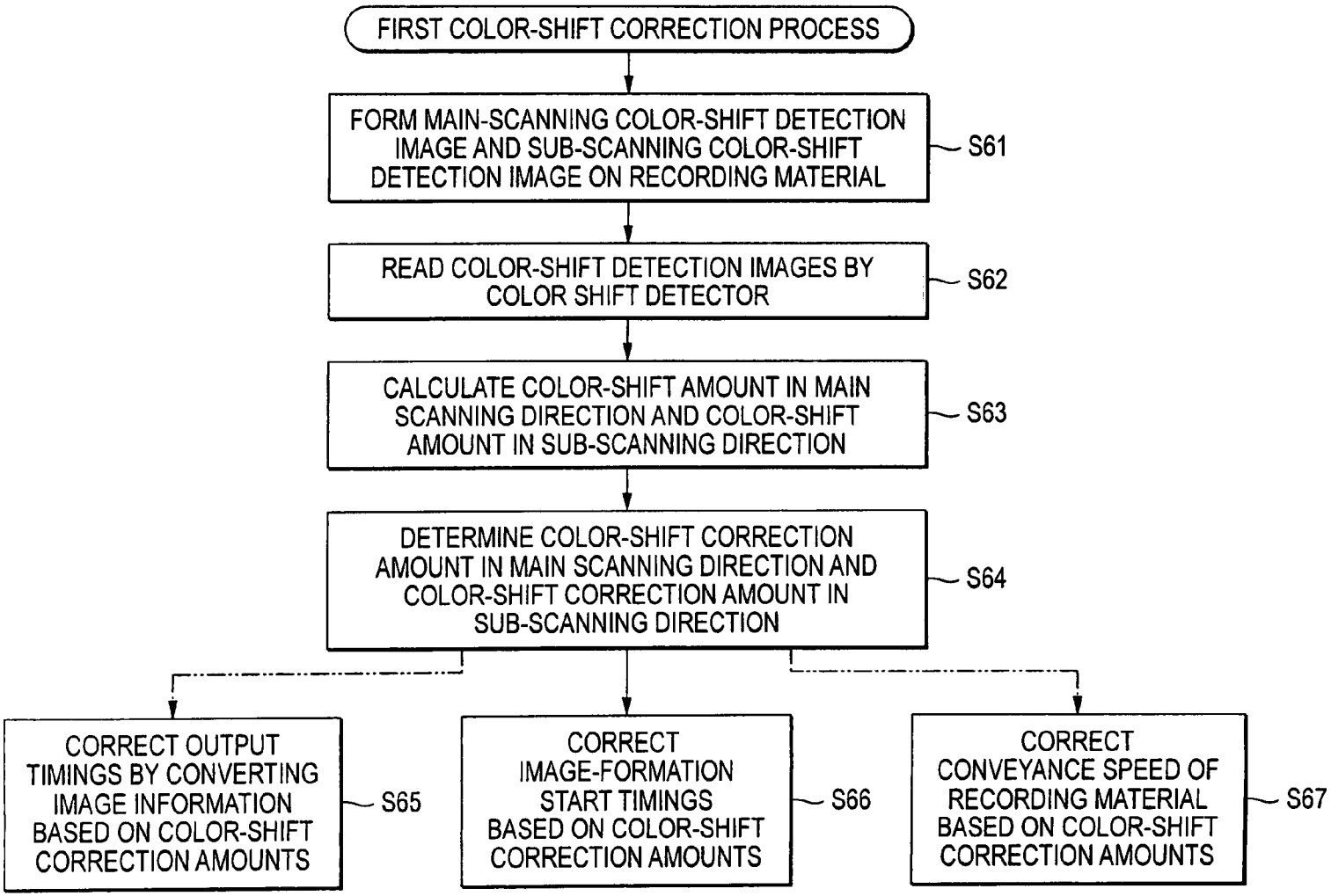
FIG. 6 is a flowchart which illustrates details of a first color-shift correction process in FIG. 5.

FIG. 6 is a flowchart illustrating an example of the first color-shift correction process shown in FIG. 5.

In the figure, the first color-shift correction process, firstly, forms on the recording material S main-scanning color-shift detection images TG (main) and sub-scanning colors-shift detection images TG (sub), which will be described later with reference to FIG. 14 (S61). In this exemplary embodiment, the "main scanning direction" is a direction parallel to an axis of the photoreceptor drum 21 (a direction perpendicular to the paper of FIG. 3), and the "sub-scanning direction" extends along the paper of FIG. 3 and is perpendicular to the main scanning direction.

Thereafter, the color shift detector 55 reads the color-shift detection images TG (S62), and a color-shift correction amount in the main scanning direction and that in the sub-scanning direction are calculated (S63).

Thereafter, a color-shift correction amount in the main scanning direction and that in the sub-scanning direction are determined (S64), and image-formation start timings of the respective image forming units are corrected based on the determined color-shift correction amounts (S66).

Figure 8:
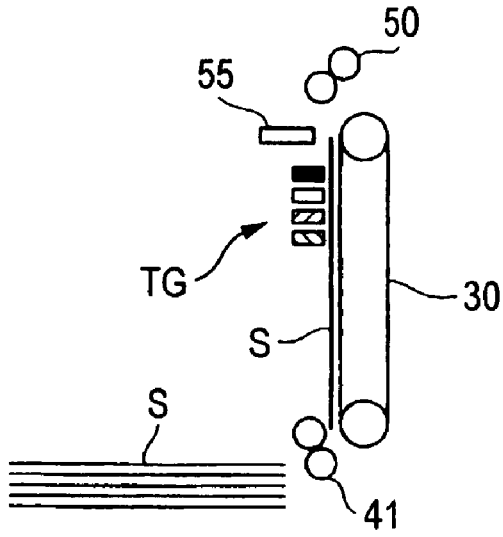
FIG. 8(*a*) is an explanatory drawing which exemplarily shows the first color-shift correction process, and FIG. 8(*b*) is an explanatory drawing which exemplarily shows the second color-shift correction process.
Figure 8:
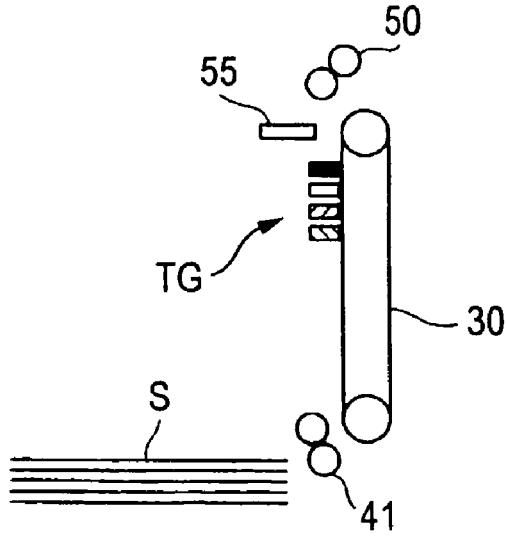

In short, as shown in FIG. 8(*a*), the first color-shift correction process detects the color-shift detection images TG formed on the recording material S by the detector 55, and performs the color-shift correction based on color-shift detection information, generated by the color shift detector 55, corresponding to the color shift on the recording material 3.

—Second Color-Shift Correction Process—

Figure 7:
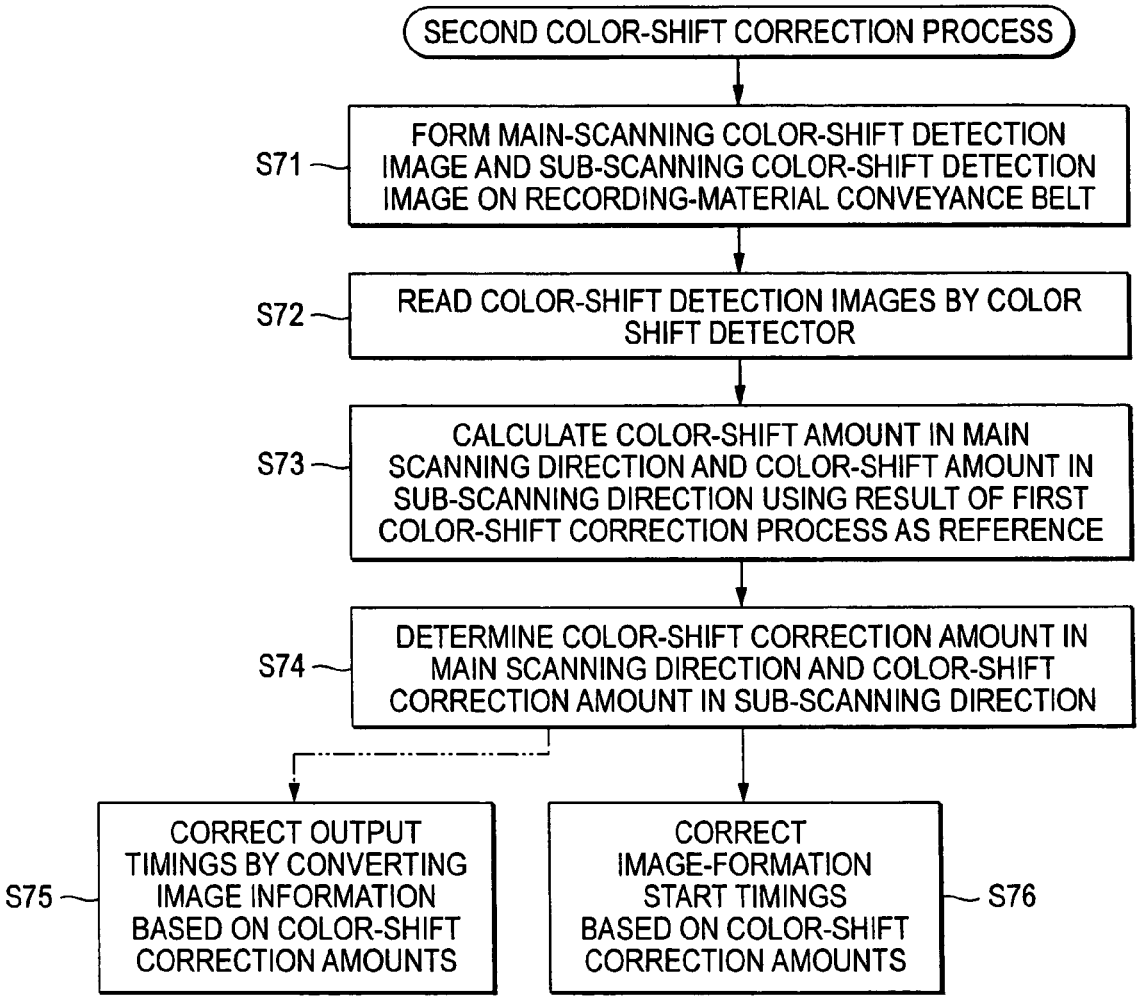
FIG. 7 is a flowchart which illustrates details of a second color-shift correction process in FIG. 5.

FIG. 7 is a flowchart illustrating an example of the second color-shift correction process shown in FIG. 5.

In the figure, the second color-shift correction process, firstly, forms on the recording-material conveyance belt 30 main-scanning color-shift detection images TG and sub-scanning color-shift detection images TG (S71).

Thereafter, the color shift detector 55 reads the color-shift detection images TG (S72) and a color-shift correction amount in the main scanning direction and that in the sub-scanning direction are calculated using the result of the first color-shift correction process as a reference (S73).

Thereafter, a color-shift correction amount in the main scanning direction and that in the sub-scanning direction are determined (S74), and image-formation start timings of the respective image forming units are corrected based on the determined color-shift correction amounts (S76).

In short, as shown in FIG. 8(*b*), the second color-shift correction process detects the color-shift detection images TG formed on the recording-material conveyance belt 30 by the detector 55 based on a result of the first color-shift correction process, so as to correct the color shifts based on an amount of change in the color-shift detection information, generated by the color shift detector 55, corresponding to the color shift on the recording-material conveyance belt 30. The amount of change in the color-shift detection information corresponding to the color shift on the recording-material conveyance belt 30 is determined using the result of the first color-shift correction process as a reference.

It is noted that the color-shift detection images TG formed on the recording-material conveyance belt 30 are cleaned by the cleaner 35.

—Behaviors of Recording Material during Conveyance—

The reason for performing the above color-shift correction processes (the first color-shift correction process and the second color shift collecting process) is to eliminate effects attributed to behaviors of the recording material during conveyance as described below.

Figure 9:
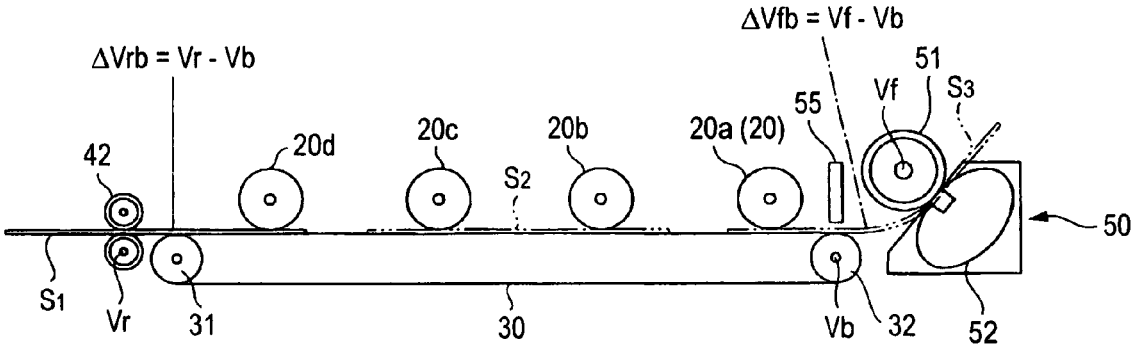
FIG. 9 is an explanatory drawing which shows factors which affect behavior of a recording material during conveyance.

That is, as shown in FIG. 9, the conveyance system for recording materials S is configured so that a recording material S is sequentially passed to the registration roller 42, the recording-material conveyance belt 30 and the fixing device 50.

In this case, let recording-material conveyance speeds of the registration roller 42, the recording-material conveyance belt 30 and the fixing device 50 be $v_r$, $v_b$ and $v_f$, respectively. These conveyance speeds never completely coincide with each other. In many cases, these conveyance speeds are set to be different from each other.

Consequently, for example, there exists a speed difference of $\Delta v_{rb}=v_r-v_b$ between the registration roller 42 and the recording-material conveyance belt 30. Therefore, a push or pull action attributed to $\Delta v_{rb}$ is generated in a recording material $S_1$ straddling between, for example, the registration roller 42 and the recording-material conveyance belt 30. Also, since there exists a speed difference of $\Delta v_{fb}=v_f-v_b$ between the recording-material conveyance belt 30 and the fixing device 50, a push or pull action attributed to $\Delta v_{fb}$ is generated in a recording material $S_3$ straddling between, for example, the fixing device 50 and the recording-material conveyance belt 30.

It is noted that since a recording material S2 not straddling to the registration roller 42 or the fixing device 50 but being conveyed only by the recording-material conveyance belt 30 is dependent only on the conveyance speed $v_b$ of the recording-material conveyance belt 30, there occurs no such push or pull action in the recording material S2.

When the recording material S is conveyed while being passed to the registration roll 42, the recording-material conveyance belt 30 and the fixing device 50, the push or pull phenomenon described above is generated to thereby change the conveyance speeds $v_r$, $v_b$, $v_f$ of the recording material S at respective positions where image transfer is performed by the respective image forming units 20. As a result, there is a concern that color shift may occur due to behaviors of the recording material S during conveyance.

Figure 10:
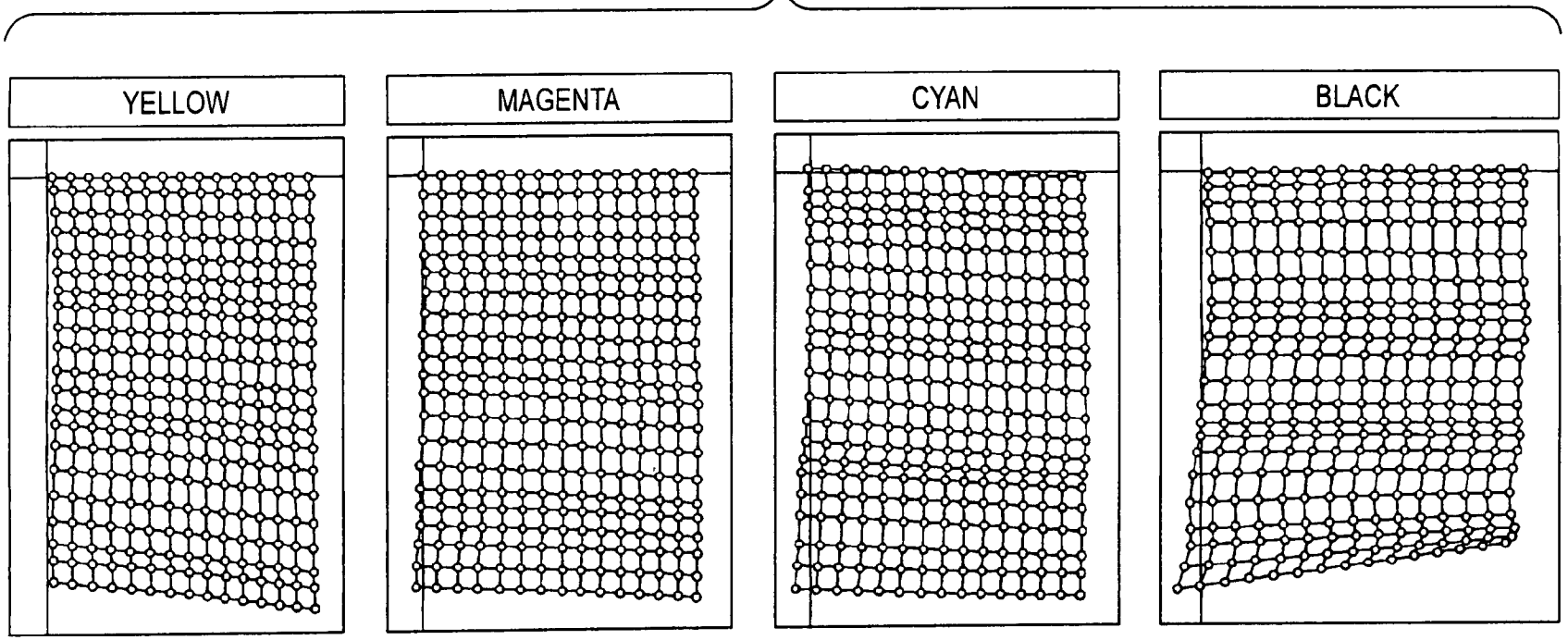
FIG. 10 is an explanatory drawing which schematically illustrates a state of color shift which is affected by the behaviors of the recording material during conveyance.

Therefore, even if color-shift detection images TG are formed on, for example, the recording-material conveyance belt 30 and are detected so as to correct color shift, color shifts appear in images of the respective color components of yellow, magenta, cyan and black (grid pattern images at predetermined intervals) on, for example, the recording material S due to the behaviors of the recording material S during conveyance, as shown in FIG. 10.

Figure 11:
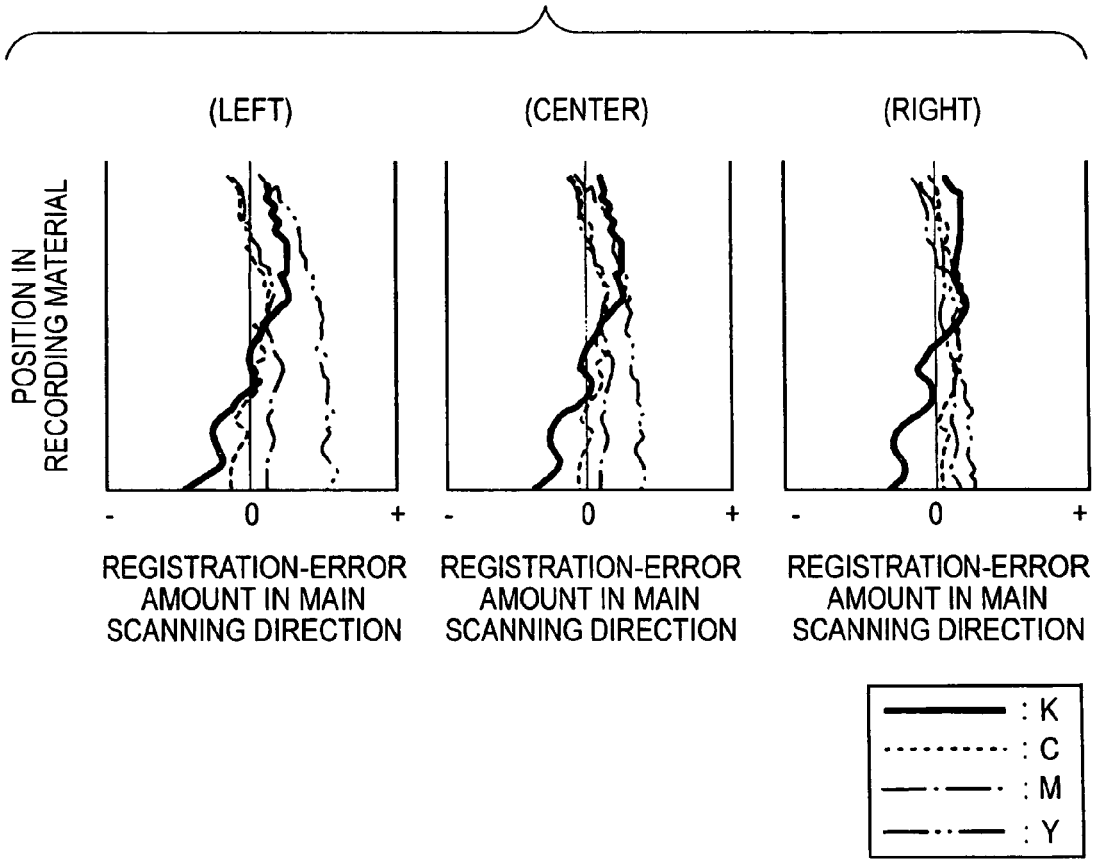
FIG. 11 is an explanatory drawing which illustrates one example of a state of color shifts (registration-error amounts) in a main scanning direction caused by effect of the behaviors of the recording material during conveyance in respective left (Left), central (Center) and right (Right) portions in a width direction of the recording material.

When the color shifts are measured quantitatively, it is understood that registration-error amounts (color-shift amounts) of respective color-component images in the main scanning direction change in a left portion (Left), a central portion (Center) and a right portion (Right) in a width direction perpendicular to the conveyance direction of the recording material S, as shown FIG. 11.

Figure 12:
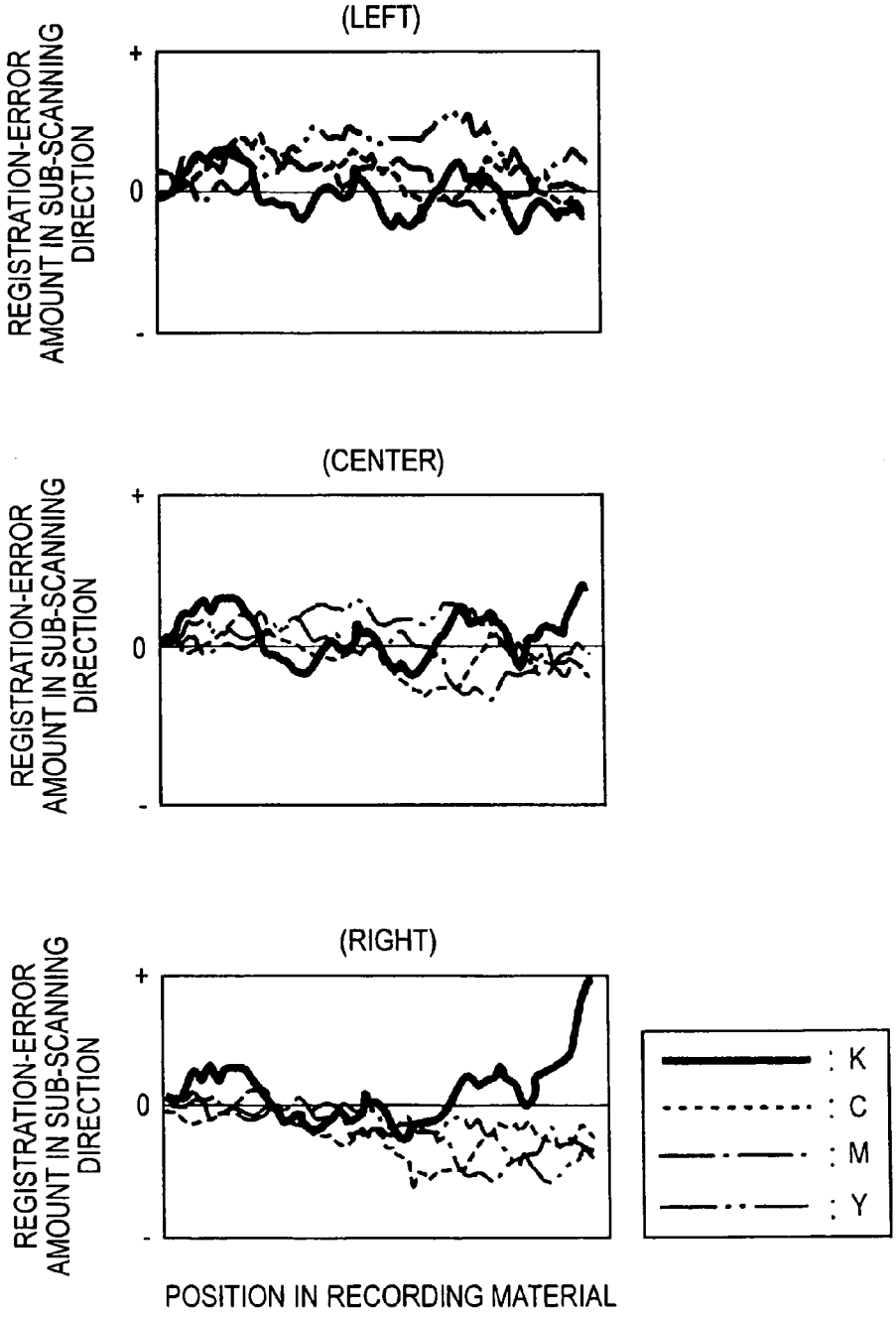
FIG. 12 is an explanatory drawing which illustrates one example of a state of color shifts (registration-error amounts) in a sub-scanning direction caused by effect of the behaviors of the recording material during conveyance in respective left (Left), central (Center) and right (Right) portions in the width direction of the recording material.

In addition, it is understood that registration-error amounts (color-shift amounts) of the respective color-component images in the sub-scanning direction change in a left portion (left), a central portion (Center) and a right portion (Right) in the width direction perpendicular to the conveyance direction of the recording material S, as shown in FIG. 12. In particular, in the registration-error amounts in the sub-scanning direction shown in FIG. 12, it is confirmed that the registration-error amounts formed by the most-downstream image forming unit 20*a* (black) are large on a downstream side of the sub-scanning direction and that the speed difference between the fixing device 50 and the recording-material conveyance belt 30 affects largely the color shift.

In the registration-error amounts in the sub-scanning direction shown in FIG. 12, the registration-error amounts formed by the most-upstream image forming unit 20*d* (yellow) are small on an upstream side of the sub-scanning direction. However, in the case that a speed difference between the registration roller 42 and the recording-material conveyance belt 30 becomes large, there is a concern that the registration-error amount of an image formed by the most-upstream image forming unit 20*d* (yellow) may become large.

Figure 13:
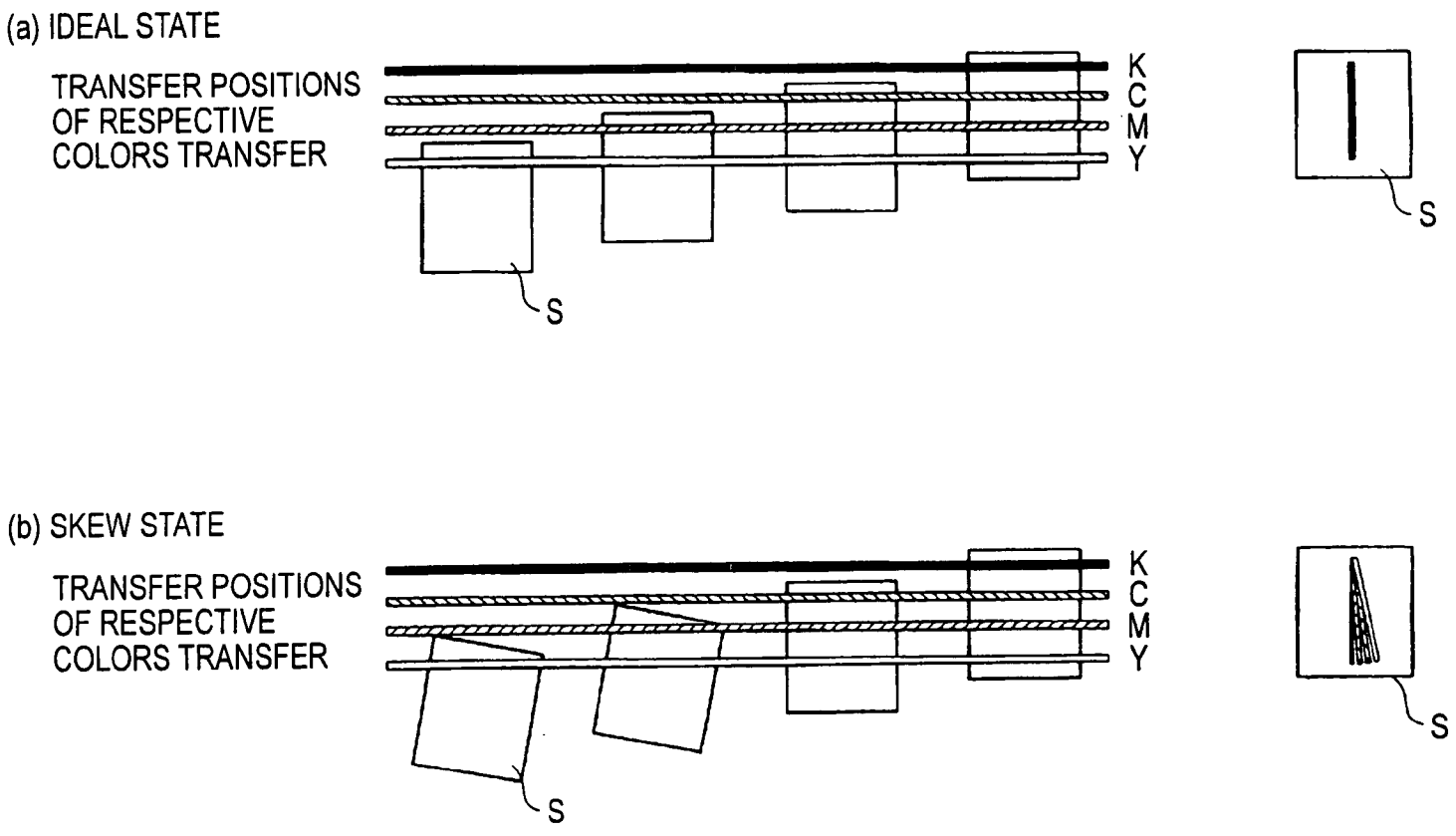
FIG. 13(*a*) is an explanatory drawing which schematically illustrates a transfer operation process of the recording material when the conveyance condition of the recording material is in an ideal condition, and FIG. 13(*b*) is an explanatory drawing which schematically illustrates a recording material transfer operation process when the conveyance condition of the recording material is in a skew condition.

Furthermore, in this exemplary embodiment, when the recording material S is conveyed in a straightly along the recording-material conveyance belt 30 as shown in FIG. 13(*a*), since the recording material S is conveyed with the posture of the recording material S remaining in the normal posture, straight-line images of the respective color components which extend along the conveyance direction of the recording material S are arranged in such a manner that the straight-line images overlap each other. However, in the case where the recording material S is conveyed with skew on the recording-material conveyance belt 30 as shown in FIG. 13(*b*), although the straight-line images of the respective color components which extend along the conveyance direction of the recording material S are arranged in such a manner that the straight-line images overlap each other, the straight-line images are inclined due to the skew posture of the recording material S, which results in color shift.

—Color-Shift Detection Image—

Figure 14:
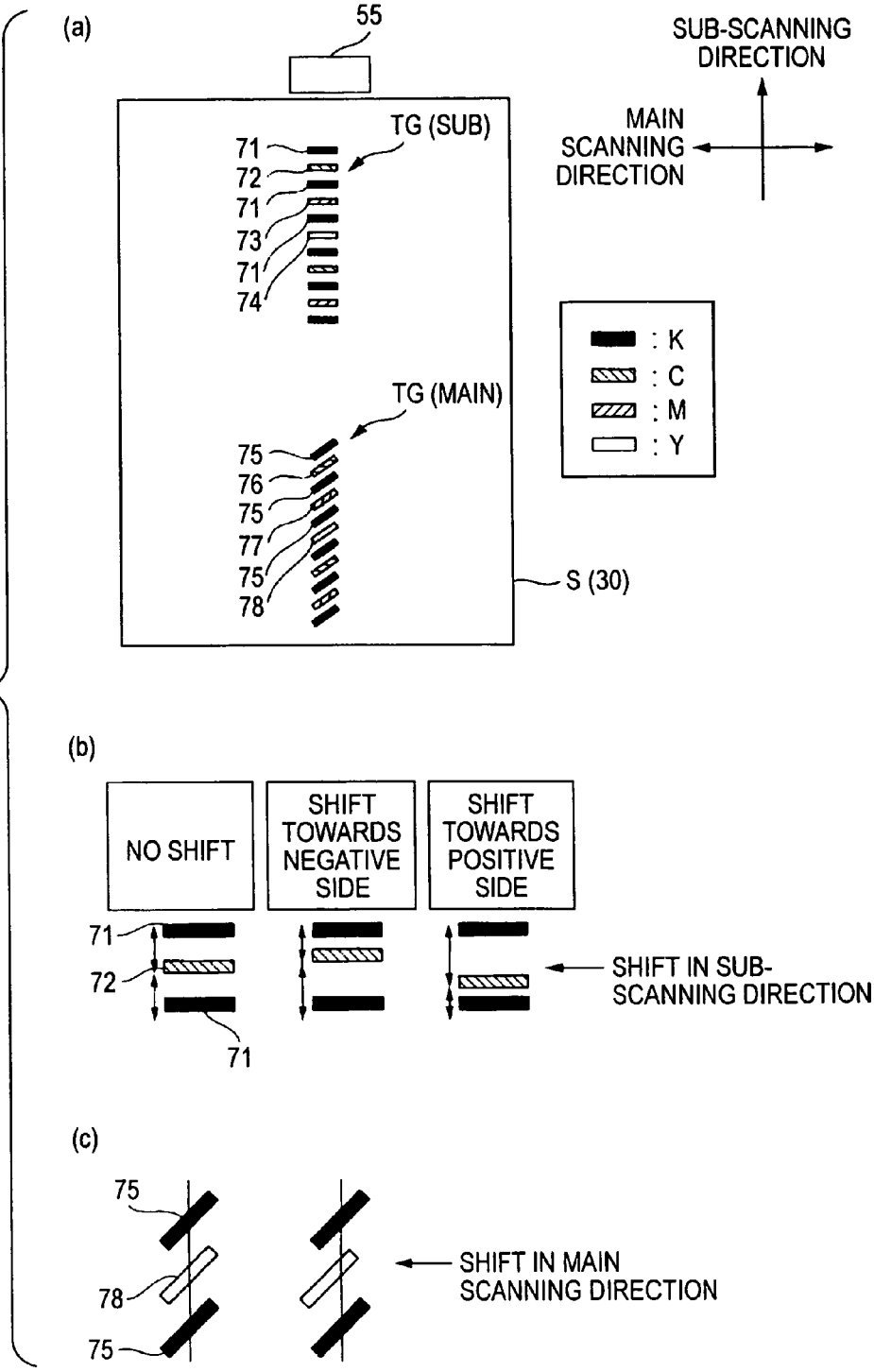
FIG. 14(*a*) is an explanatory drawing which illustrates one example of color-shift detection patterns which are formed on a recording material or a recording-material conveyance belt in a color-shift detection image formation process according to the exemplary embodiment 1, FIG. 14(*b*) is an explanatory drawing which illustrates color shifts in the sub-scanning direction, and FIG. 14(*c*) is an explanatory drawing which shows color shifts in the main scanning direction.

In this exemplary embodiment, as color-shift detection images, a sub-scanning color-shift detection pattern TG (sub) and a main-scanning color-shift detection pattern TG (main) are used as shown in FIG. 14(*a*).

Here, in the sub-scanning color-shift detection pattern TG (sub), a cyan (C) rectangular patch 72, a magenta (M) rectangular patch 73 and a yellow (Y) rectangular patch 74 are disposed at predetermined pitches (specified values) relative to a rectangular patch 71 of black, which is a reference color.

At this time, as shown in FIG. 14(*b*), if an interval between the rectangular patch 72 of a correction target color (for example cyan (C)) and the rectangular patch 71 of the reference color is equal to the specified value, there occurs no color shift. However, if the interval therebetween is smaller than the specified value, it means that there occurs a color shift towards a negative side (− side). Also, if the interval therebetween is larger than the specified value, it means that a color shift occurs towards a positive side (+ side).

In addition, in the main-scanning color-shift detection pattern TG (main), inclined patches 75 to 78 are inclined relative to the sub-scanning direction and an inclined patch 76 of cyan (C), an inclined patch 77 of magenta (M) and an inclined patch 78 of yellow (Y) are arranged at predetermined pitches (specified values) relative to an inclined patch 75 of black, which is the reference color.

At this time, in the case where the position of the inclined patch 78 of a correction target color (for example, yellow (Y)) does not shift in the main scanning direction relative to, for example, the inclined patch 75 of black, which is the reference color, it means that there occurs no color shift. Whereas, in the case where the inclined patch 78 shifts in the main scanning direction relative to the inclined patch 75 of black, which is the reference color, it means that there occurs color shift towards a negative side or a positive side.

—Detecting Principle of Color-Shift Detection Pattern—

Figure 15:
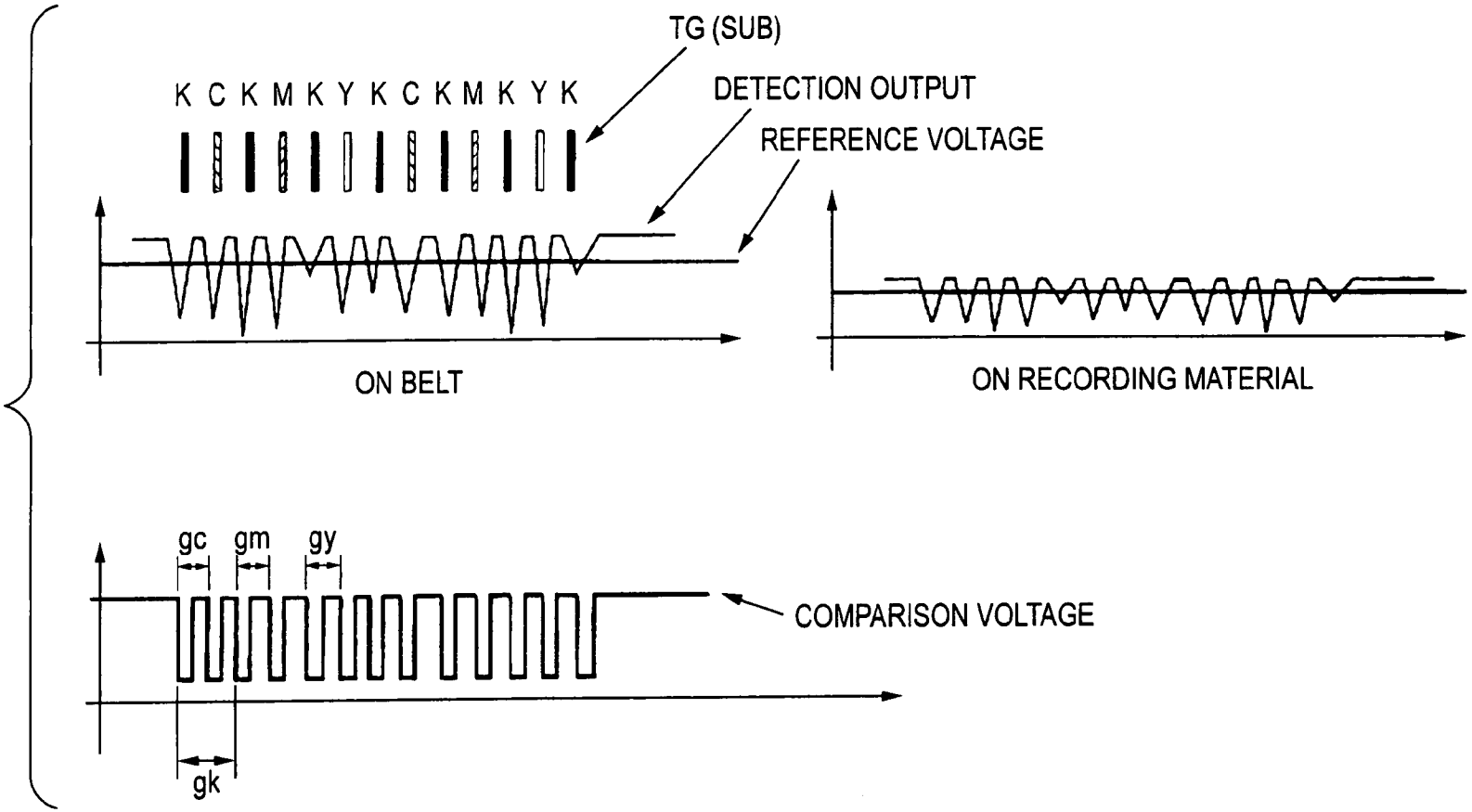
FIG. 15 is an explanatory drawing which shows an operation principle of detecting a sub-scanning color-shift detection pattern according to the exemplary embodiment 1.

FIG. 15 is an explanatory diagram which illustrates a detecting principle of a sub-scanning color-shift detection pattern.

In the figure, a sub-scanning color-shift detection pattern TG (sub) is formed on the recording-material conveyance belt 30, the thus-formed pattern is detected by the detector 55, a detection output from this detector 55 is binarized based on a reference voltage to obtain comparison voltages ($g_c$: a time difference (referred to as "gap") between the black rectangular patch and the cyan rectangular patch; $g_m$: a gap between the black rectangular patch and the magenta rectangular patch; $g_y$: a gap between the black rectangular patch and the yellow rectangular patch; $g_k$: a gap between the black rectangular patches) indicating color-shift amounts corresponding to the color-shift detection pattern TG (sub).

When the sub-scanning color-shift detection pattern TG (sub) is formed on a recording material S and is detected by the color shift detector 55, a detection output shown in FIG. 15 is obtained. Then, if the obtained detection output is binarized based on the reference voltage, comparison voltages corresponding to the color-shift amounts can be obtained.

Figure 16:
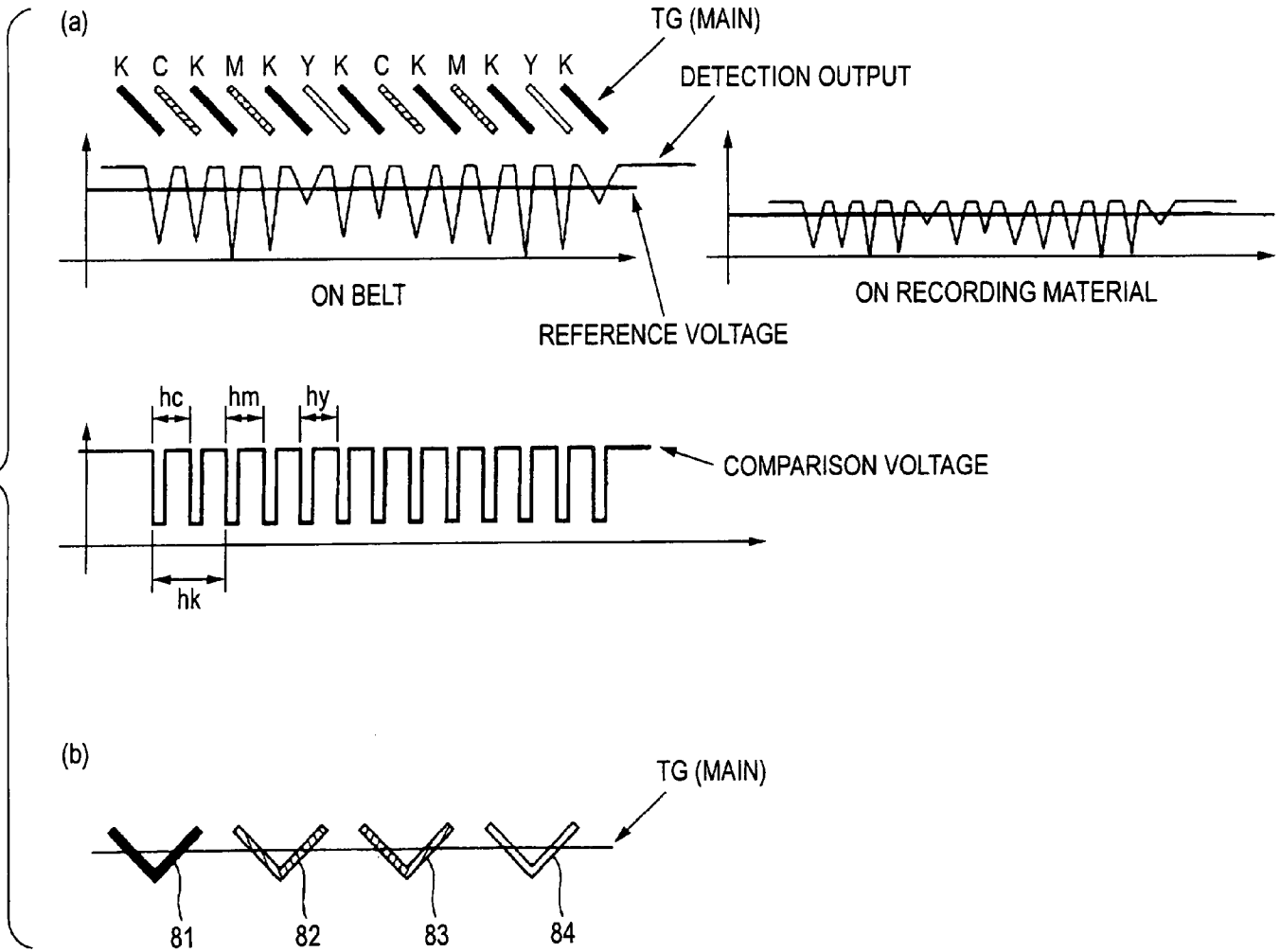
FIG. 16(*a*) is an explanatory drawing which shows an operation principle of detecting a main-scanning color-shift detection pattern according to the exemplary embodiment 1, and FIG. 16(*b*) is an explanatory drawing which shows another operation principle of detecting the main-scanning color-shift detection pattern.

In addition, FIG. 16(*a*) is an explanatory drawing which illustrates a detecting principle of the main-scanning color-shift detection pattern.

In the figure, a main-scanning color-shift detection pattern TG (main) is formed on the recording-material conveyance belt 30, the thus-formed pattern is detected by the detector 55, a detection output from the detector 55 is binarized based on a reference voltage to obtain comparison voltages ($h_c$: a gap between the black inclined patch and the cyan inclined patch; $h_m$: a gap between the black inclined patch and the magenta inclined patch; $h_y$: a gap between the black inclined patch and the yellow inclined patch; $h_k$: a gap between the black inclined patches) indicating color-shift amounts corresponding to corresponding to the color-shift detection pattern TG (main).

When the main-scanning color-shift detection pattern TG (main) is formed on a recording material S and is detected by the color shift detector 55, a detection output as shown in FIG. 16(*a*) is obtained. Then, if the obtained detection output is binarized based on the reference voltage, a comparison voltage corresponding to the color-shift amount can be obtained.

In addition, the main-scanning color-shift detection pattern TG (main) is not limited to such a mode that the inclined patches 75 to 78 are arranged as described above. For example, V-shaped patches 81 to 84 may be arranged for the respective color components.

—Correction of Image-Formation Start Timings—

<Color-Shift Correction in Sub-Scanning Direction>

Figure 17:
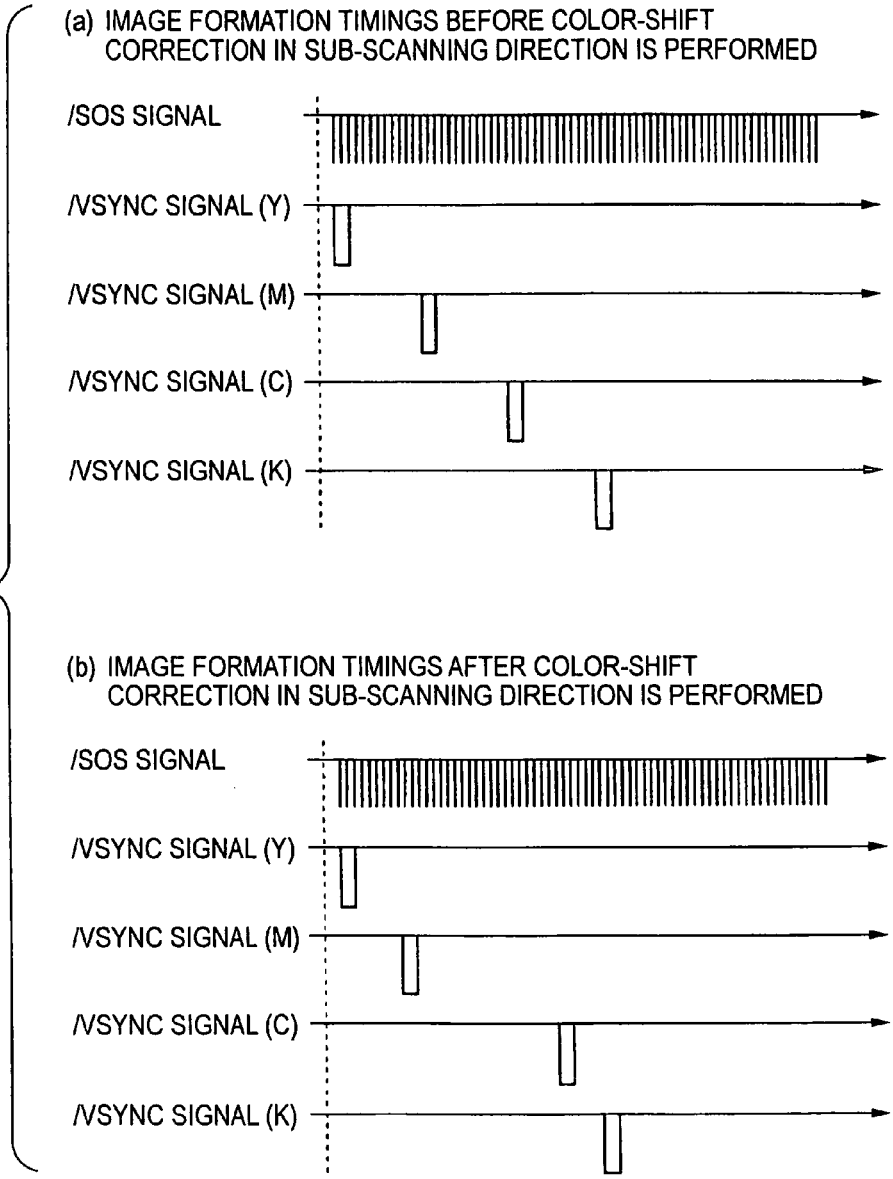
FIG. 17(*a*) is an explanatory drawing which shows image formation timings before color-shift corrections in the sub-scanning direction are performed, and FIG. 17(*b*) is an explanatory drawing which shows image formation timings after the color-shift corrections in the sub-scanning direction are performed.

It is assumed that image formation timings before color-shift correction is performed are ones shown in FIG. 17(*a*). In the figure, an SOS (stands for Start of Scan) signal denotes a scanning starting signal for each color-component illumination light in the exposing unit 25, and VSYNC signal (Y) to VSYNC signal (K) denote synchronizing signals of the respective color components in the sub-scanning direction and are synchronized at predetermined timings, which are determined from the SOS signals in advance.

In this exemplary embodiment, when color-shift amounts in the sub-scanning direction are calculated from the sub-scanning color-shift detection pattern TG (sub) as described above, the control unit 60 (see FIG. 4) determines color-shift correction amounts so as to cancel the calculated color-shift amounts and corrects the image creating timings represented by the VSYNC signal (Y) to VSYNC signal (K) based on the color-shift correction amounts.

<Color-Shift Correction in Main Scanning Direction>

Figure 18:
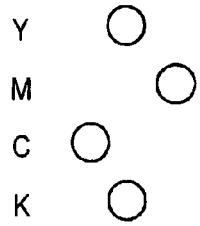
FIG. 18(*a*) is an explanatory drawing which shows a relationship between beams, in an exposing unit, which correspond to respective colors, FIG. 18(*b*) is an explanatory drawing which shows image formation timings before color-shift corrections in the main scanning direction are performed, and FIG. 18(*c*) is an explanatory drawing which shows image formation timings after the color-shift corrections in the main scanning direction are performed.
Figure 18:
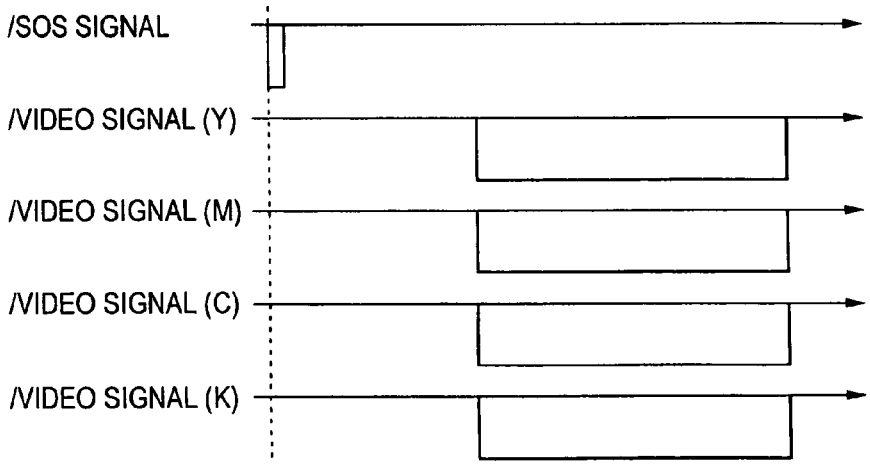
Figure 18:
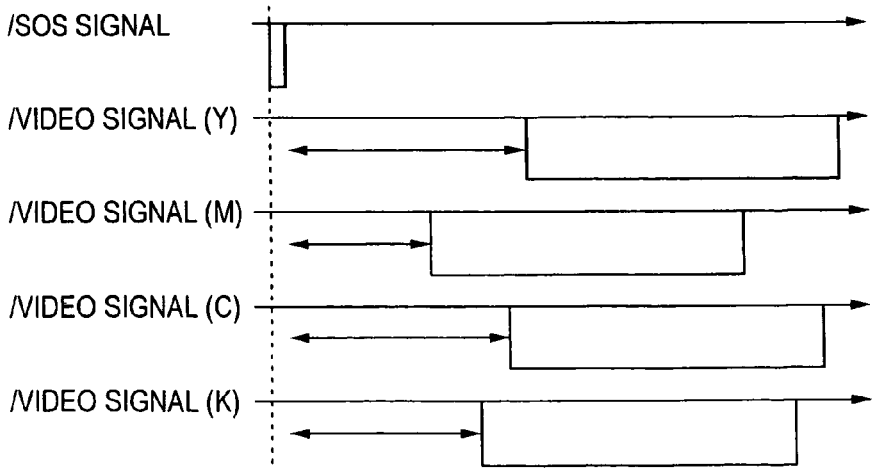

It is assumed that image formation timings before color-shift correction is performed are ones shown in FIG. 18(*b*). In the figure, an SOS (stands for Start of Scan) signal denotes a scanning starting signal for each color-component illumination light in the exposing unit 25, and VIDEO signal (Y) to VIDEO signal (K) denote synchronizing signals of the respective color components in the main scanning direction and are synchronized at predetermined timings, which are determined from the SOS signals in advance.

In this exemplary embodiment, as shown in FIG. 18(*a*), positional relationships of beams (illumination light) corresponding to the respective colors (YMCK) of the exposing unit 25 with respect to the respective image forming units 20 are not constant. Before the color-shift correction is performed, the image formation timings of the VIDEO signal (Y) to VIDEO signal (K) of the respective colors are adjusted so as to be identical.

In this exemplary embodiment, however, when color-shift amounts in the main scanning direction are calculated from the main-scanning color-shift detection pattern TG (main) as described above, the control unit 60 determines color-shift correction amounts so as to cancel the calculated color-shift amounts and corrects the image formation timings represented by the VIDEO signal (Y) to VIDEO signal (K) based on the color-shift correction amounts, as shown in FIG. 18(*c*).

In particular, in the second color-shift correction, the result of the correction performed for the image formation timing by the first color-shift correction is used as a reference, and a difference from this reference pattern is calculated as a color-shift amount.

Exemplary Embodiment 2

Figure 19:
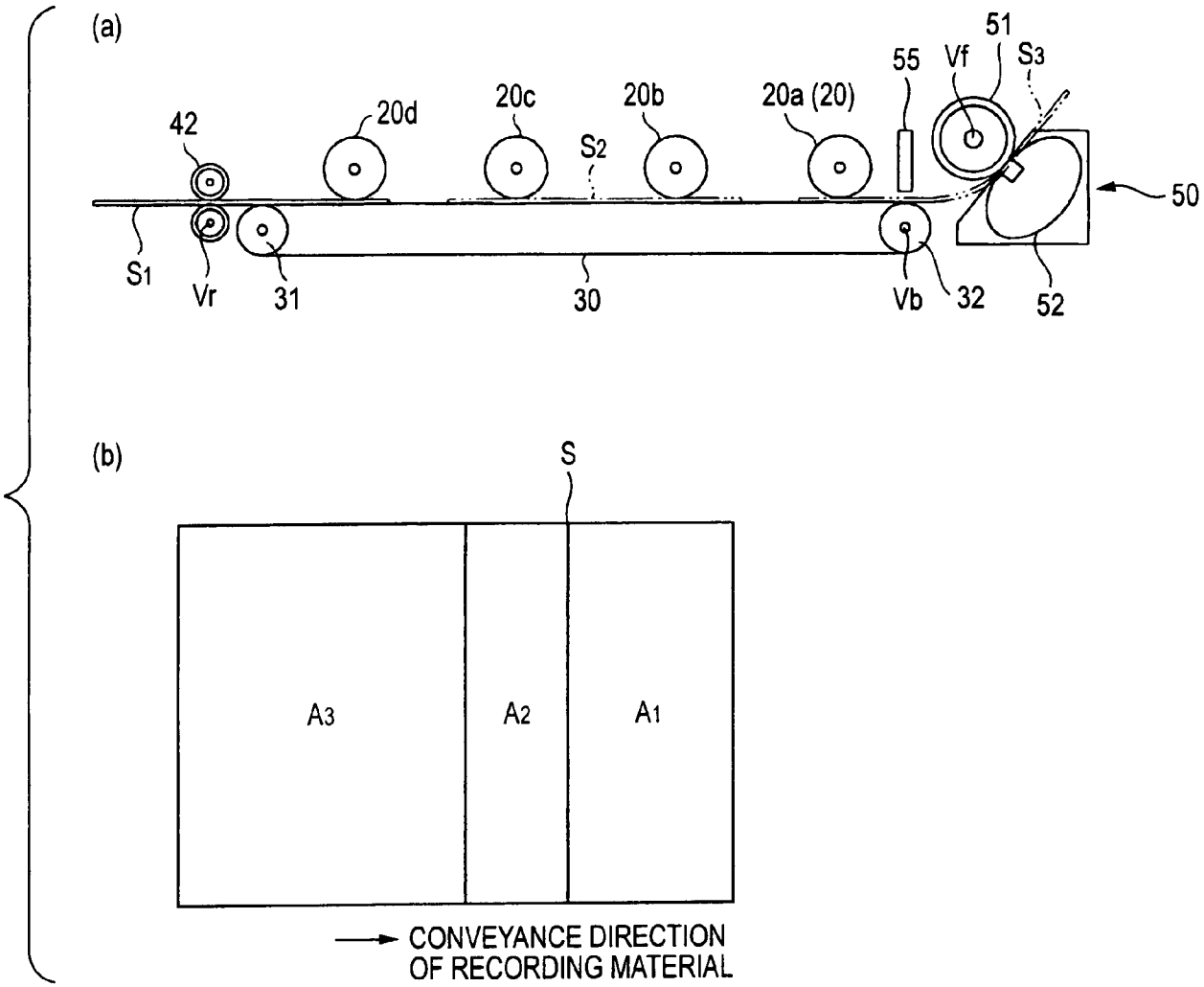
FIG. 19(*a*) is an explanatory drawing which schematically illustrates a color image forming apparatus according to an exemplary embodiment 2, and FIG. 19(*b*) is an explanatory drawing which shows a difference, within a recording material, in effect of behaviors of the recording material during conveyance.

FIG. 19(*a*) is an explanatory drawing which schematically illustrates a color image forming apparatus according to an exemplary embodiment 2.

In the figure, the basic configuration of the color image forming apparatus is substantially similar to that of the exemplary embodiment 1. However, the color image forming apparatus of this exemplary embodiment is different from that in the exemplary embodiment 1 in the first color-shift correction process. Specifically, a part of the first color-shift correction process is changed. It is noted that similar reference numerals will be given to similar elements to those of the exemplary embodiment 1 and detailed description thereon will be omitted here.

In the figure, a recording material S is conveyed while being passed over to the registration roller 42, the recording-material conveyance belt 30 and the fixing device 50 sequentially.

At this time, the conveyance speed of a recording material $S_1$ which is conveyed while straddling between the registration roll 42 and the recording-material conveyance belt 30 tends to easily change due to a speed difference ($v_r$–$v_b$) therebetween. Also, the conveyance speed of a recording material $S_3$ which is conveyed while straddling between the fixing device 50 and the recording-material conveyance belt 30 tends to easily change due to a speed difference ($v_f$–$v_b$) therebetween. A recording material S2, which is conveyed only by the recording-material conveyance belt 30, is not affected by other conveyance members which are located before and after the recording-material conveyance belt 30. Therefore, the recording material S2 is conveyed stably.

When focusing on the behaviors of such a recording material S during conveyance, as shown in FIG. 19(*b*), a downstream-side area $A_1$, in the conveyance direction, of the recording material S is largely affected by the registration roller 42, while an upstream-side area $A_3$, in the conveyance direction, of the recording material S is largely affected by the fixing device 50. A central area $A_2$, in the conveyance direction, of the recording material S is affected by neither the registration roller 42 nor the fixing device 50.

In particular, in this exemplary embodiment, the first color-shift correction process corrects a conveyance speed of the recording material S based on color-shift correction amount, as shown by imaginary lines in FIG. 6, in place of correcting the image-formation start timings based on the color-shift amount.

Figure 20:
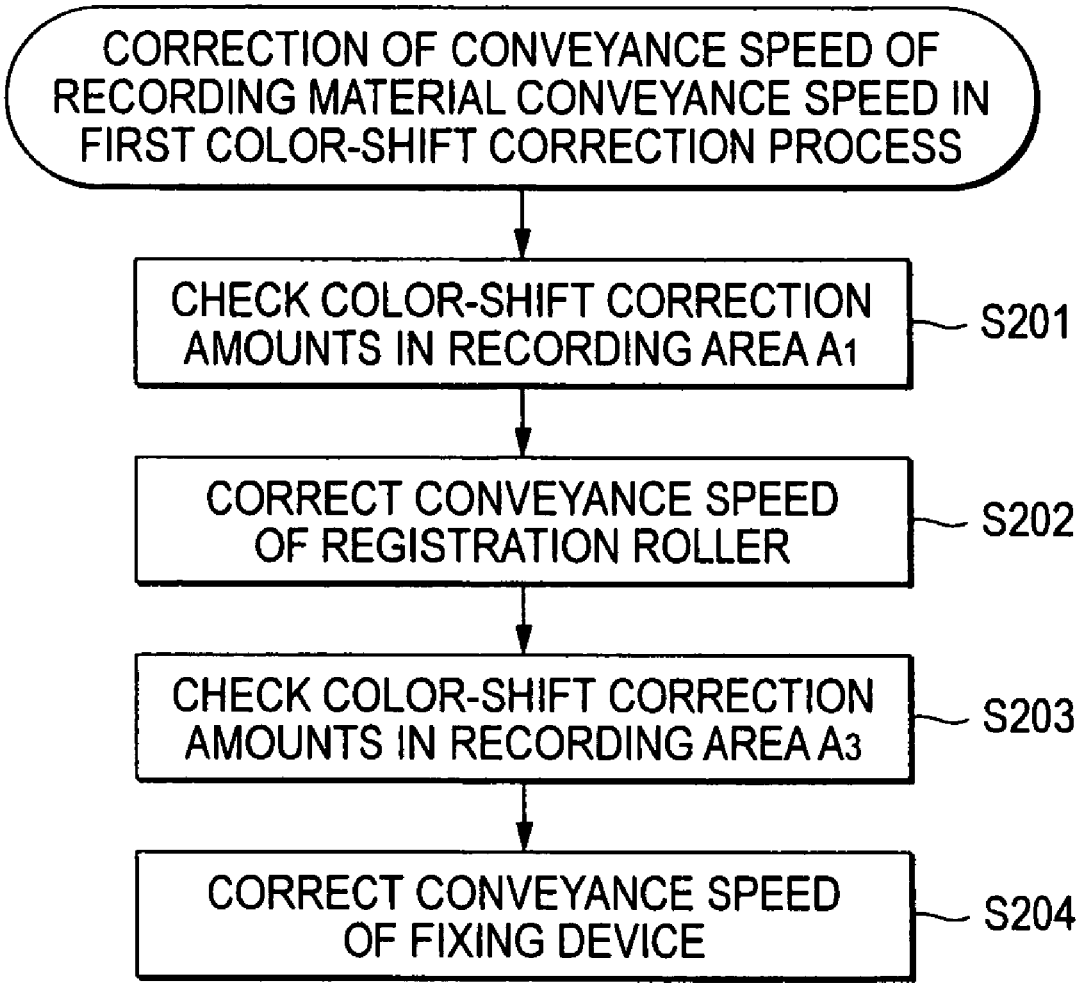
FIG. 20 is a flowchart which illustrates details of correction of a conveyance speed of a recording material performed in the first color-shift correction process of the exemplary embodiment 2.

Specifically, as shown in FIG. 20, the first color-shift correction process checks color-shift correction amounts in the area $A_1$ of the recording material (S201) and corrects the conveyance speed of the registration roller 42 (S202). Furthermore, the first color-shift correction process checks color-shift correction amounts in the area $A_3$ of the recording material S (S203) and corrects the conveyance speed of the fixing device 50 (S204).

With this process, the speed differences relative to the recording-material conveyance belt 30 can be adjusted by correcting the conveyance speed of the registration roller 42 and the conveyance speed of the fixing device 50. As a result, color shifts attributed to the effects of the behaviors of the recording material S during conveyance cam be corrected effectively.

Figure 21:
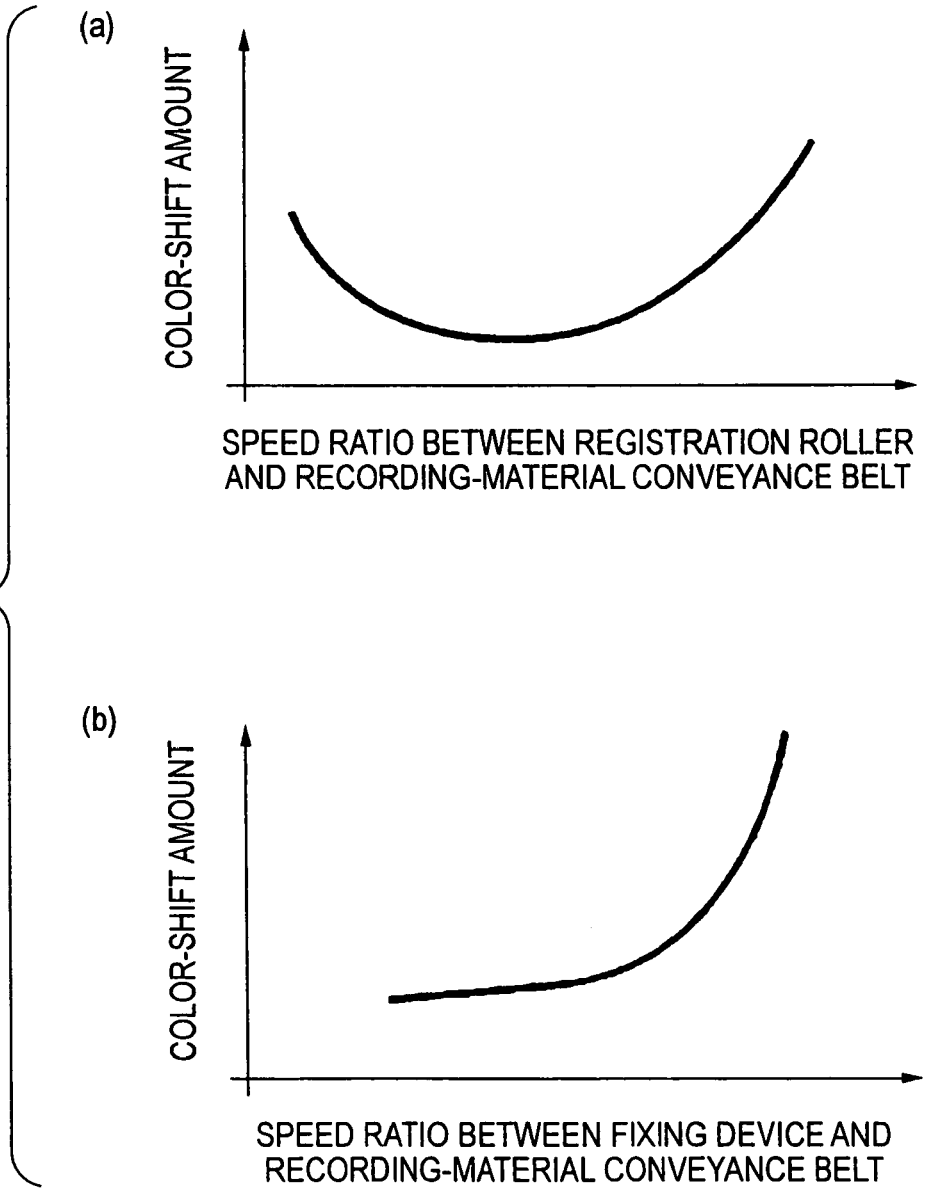
FIG. 21(*a*) is an explanatory drawing which shows one example of a relationship between (i) a speed ratio between a registration roller and a recording-material conveyance belt and (ii) a color-shift amount, and FIG. 21(*b*) is an explanatory drawing which shows one example of a relationship between (i) a speed ratio between a fixing device and a recording-material conveyance belt and (ii) a color-shift amount.

In this exemplary embodiment, when a relationship between (i) a speed ratio between the registration roller and the recording-material conveyance belt and (ii) a color-shift amount is investigated, it is confirmed that there exists a correlation as shown in FIG. 21(*a*). When a relationship between (i) a speed ratio between the fixing device and the recording-material conveyance belt and (ii) a color-shift amount is investigated, it is confirmed that there exists a correlation as shown in FIG. 21(*b*). It is noted that the color-shift amount in FIG. 21 shows mean values of the color-shift amounts of the respective color components.

At this time, it is difficult to maintain the respective speed ratios constant at all times. Also, there is a possibility that the speed ratios change due to combinations based on tolerances, wear and environment change. It is understood that if the speed ratios change, the behaviors of the recording material S during conveyance change, which results in that the color-shift amounts tend to increase.

Figure 22:
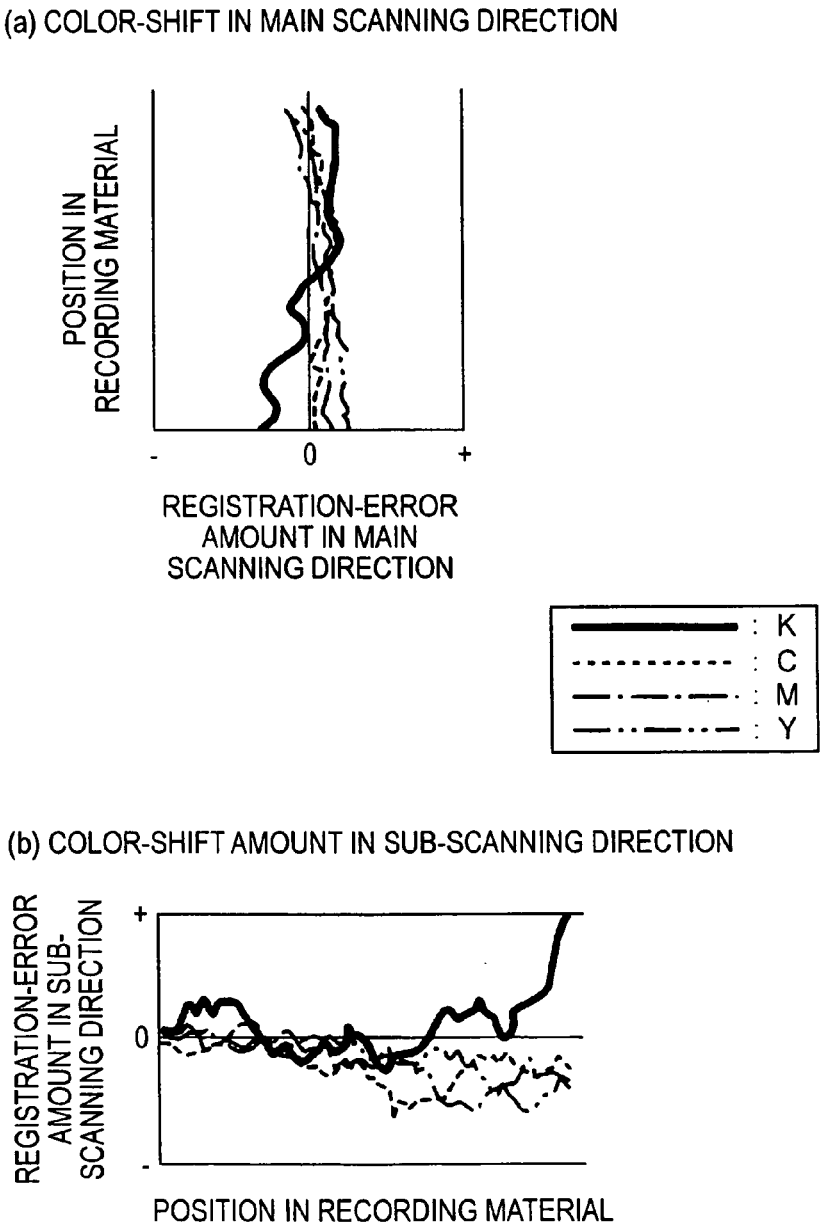
FIG. 22(*a*) is an explanatory drawing which shows one example of a state of color shifts (registration-error amounts) in the main scanning direction, and FIG. 22(*b*) is an explanatory drawing which shows one example of a state of color shifts (registration-error amounts) in the sub-scanning direction.

Also, in this exemplary embodiment, when investigating the color-shift detection images (the color-shift detection pattern) TG used in the first color-shift correction, for example, a tendency shown in FIG. 22(*a*) appears in terms of the color shifts in the main scanning direction, while a tendency shown in FIG. 22(*b*) appears in terms of the color shifts in the sub-scanning direction.

For example, in the color shifts in the main scanning direction shown in FIG. 22(*a*), the recording-material conveyance directions of the fixing device 50 and the recording-material conveyance belt 30 are changed due to a difference in recording-material conveyance speed therebetween, from the upstream-side area $A_3$, in the conveyance direction, of the recording material S. Because of this, a color-shift amount caused by the most-downstream image forming unit 20*a* (black) appears in the upstream-side portion, in the recording material conveyance direction, of the recording material.

Also, in the color shifts in the sub-scanning direction shown in FIG. 22(*b*), the recording-material conveyance directions are changed due to the difference in recording-material conveyance speed from the upstream-side area $A_3$, in the conveyance direction, of the recording material S. Because of this, a color-shift amount caused by the most-downstream image forming unit 20*a* (black) appears in the upstream-side portion, in the recording-material conveyance direction, of the recording material.

FIGS. 22(*a*), (*b*) show that the color shifts attributed to the difference in conveyance speed between the fixing device 50 and the recording-material conveyance belt 30. However, it is obvious that when color shifts are generated due to a difference in recording-material conveyance speed between, for example, the registration roller 42 and the recording-material conveyance belt 30, this exemplary embodiment can correct such a color-shift.

Exemplary Embodiment 3

Figure 23:
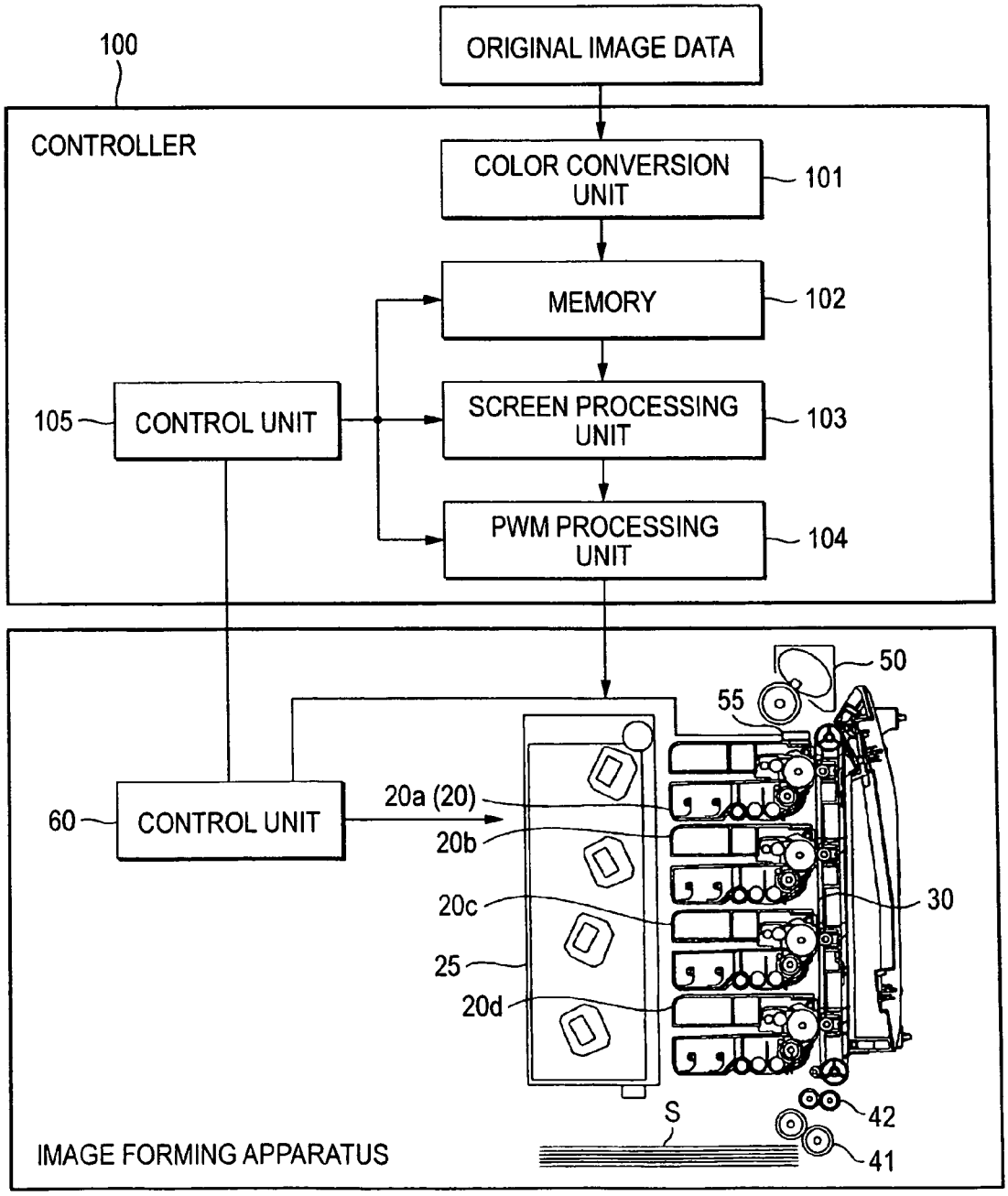
FIG. 23 is an explanatory drawing which schematically illustrates a color image forming apparatus according to an exemplary embodiment 3.

FIG. 23 schematically shows a color image forming apparatus according to an exemplary embodiment 3.

In the figure, the basic configuration of the color image forming apparatus of this exemplary embodiment is substantially similar to that of the exemplary embodiment 1. However, the color image forming apparatus of this exemplary embodiment is different from Exemplary embodiment 1 in the first color-shift correction process and the second color-shift correction process. It is noted that similar reference numerals will be given to similar elements to those of the exemplary embodiment 1 and that the detailed description thereon will be omitted here.

In the figure, the color image forming apparatus includes a controller 100 for sending to the exposing unit 25 image data obtained by performing a predetermined process for original image data.

This controller 100 includes a color conversion unit 101, a memory, a screen processing unit 103, a PWM processing unit 104 and a control unit 105. The color conversion unit 101 converts the original image data into respective color-component image data. The memory 102 stores the respective color-component image data converted by the color conversion unit 101. The screen processing unit 103 performs screen processing for the respective color-component image data stored in the memory 102 and corrects output timings of latent images to be formed on the photoreceptor drums 21 by converting the color-component image data. The pulse width modulation (PWM) processing unit 104 performs pulse width modulation for the respective color-component image data processed by the screen processing unit 103. The control unit 105 receives control information from the control unit 60 on the image-forming-apparatus side and controls the screen processing unit 103 and the pulse width modulation processing unit 104 using the image data stored in the memory 102.

In this exemplary embodiment, the first color-shift correction process is, basically, substantially similar to that of the exemplary embodiment 1. However, as shown by the imaginary lines in FIG. 6, the first color-shift correction process of this exemplary embodiment corrects output timings of latent images to be formed on the photoreceptor drums 21 by converting image information (respective color-component image data) based on the color-shift correction amounts, in place of correcting the image-formation start timings based on the color-shift correction amounts.

Also, the second color-shift correction process is, basically, substantially similar to that of the exemplary embodiment 1. However, as shown by imaginary lines in FIG. 7, the second color-shift correction process of this exemplary embodiment corrects output timings by converting the image information (respective color-component image data) based on the color-shift correction amounts, in place of correcting the image-formation start timings based on the color-shift correction amounts.

Figure 24:
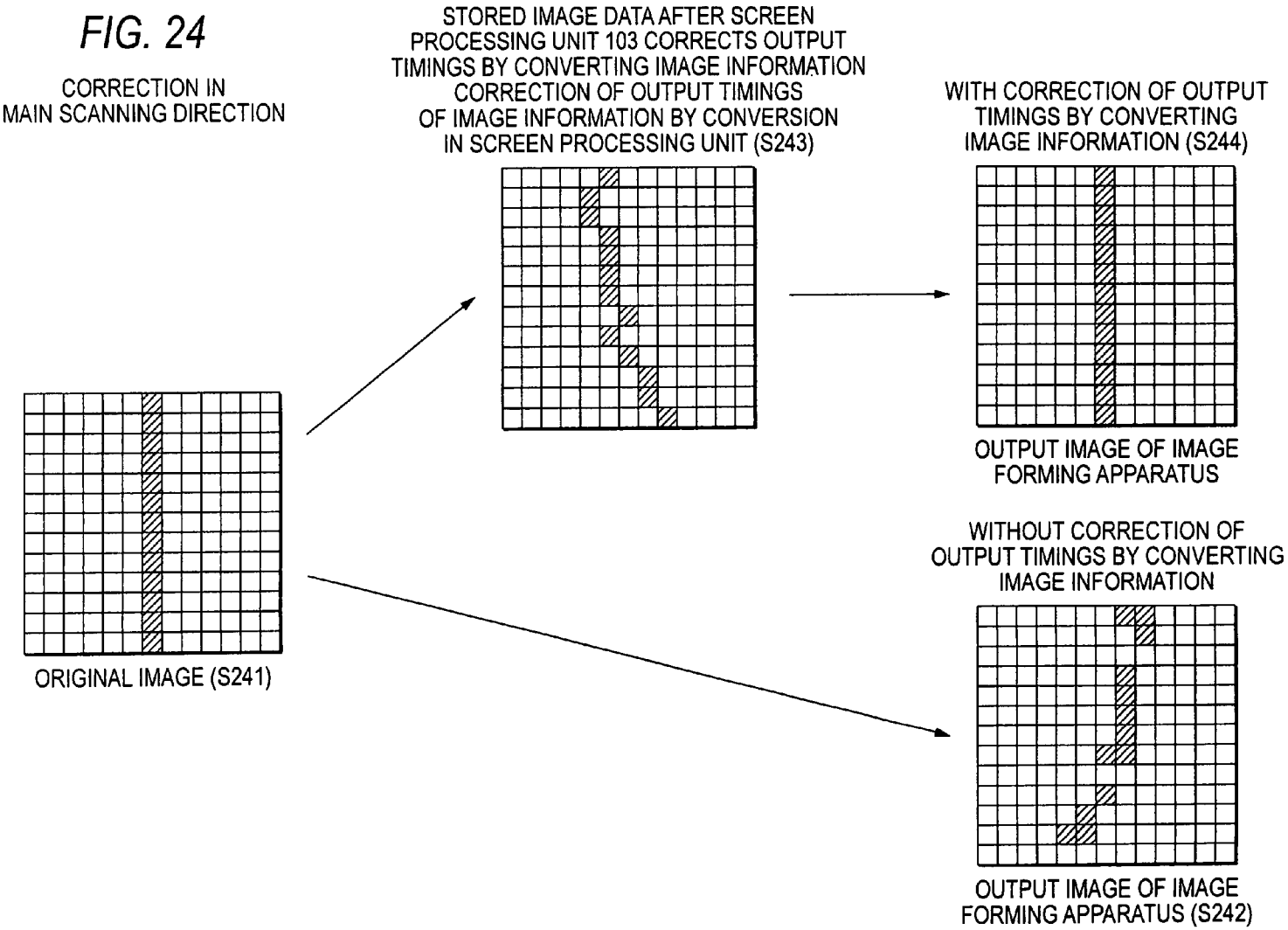
FIG. 24 is an explanatory drawing which shows a correction principle in the main scanning direction in the color image forming apparatus according to the exemplary embodiment 3.

More specifically, usually image data (image information) is prepared under the assumption that there is no color-shift correction, e.g., a recording medium is conveyed without receiving disturbance from the first conveyance unit 2, the registration roller 42 and the fixing device 10. Therefore, for example, in the case where no color-shift correction in the main scanning direction is performed, an original image, which is a straight-line image, would be output as a non-straight-line image due to color shifts in the main scanning direction as shown in the lower portion of FIG. 24 (S241=>S242).

Because of this, in this exemplary embodiment, the control unit 105 of the controller 100 receives the color-shift correction amounts in the main scanning direction based on the control signal from the control unit 60 on the image-forming-apparatus side and causes the screen processing unit 103 to correct output timings of latent images to be formed on the photoreceptor drums 21 by converting the respective color-component image data (image information) based on the received color-shift correction amounts (S241=>S243). After again storing the converted color-component image data in the memory 102, the control unit 105 sends the stored image data, to which the output-timing correction has been performed, to the exposing unit 25 via the pulse width modulation processing unit 104 (see an upper portion of FIG. 24; S243=>S244).

Figure 25:
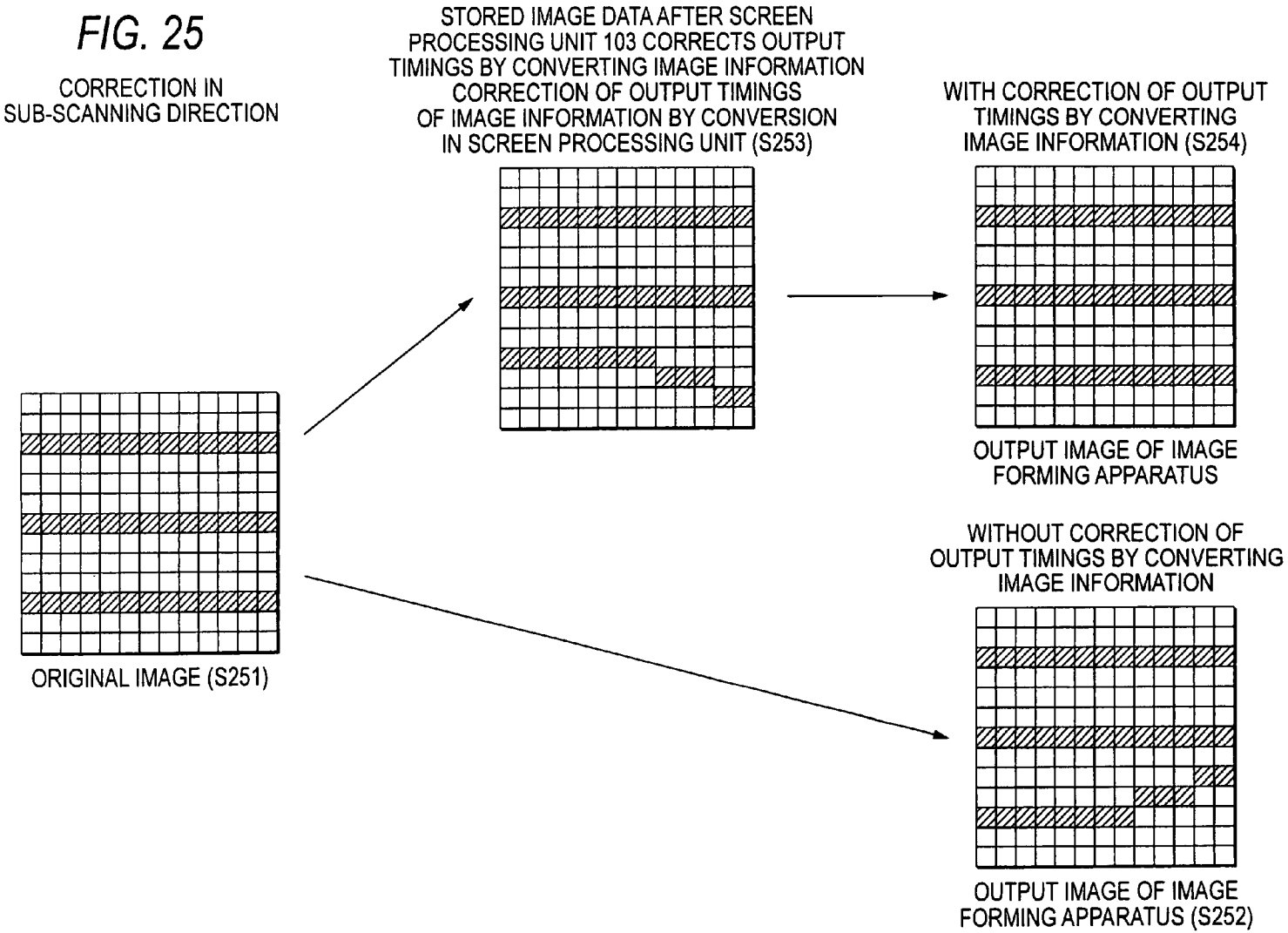
FIG. 25 is an explanatory drawing which shows a correction principle in the sub-scanning direction in the color image forming apparatus according to the exemplary embodiment 3.

On the other hand, in the case where no color-shift correction in the sub-scanning direction is performed, for example, a part of an original image including plural straight-line images would be output as a non-straight-line image as shown in a lower portion of FIG. 25 (S251=>S252) due to color shifts in the sub-scanning direction.

Because of this, in this exemplary embodiment, the control unit 105 of the controller 100 receives color-shift correction amounts in the sub-scanning direction based on the control signal from the control unit 60 on the image-forming-apparatus side and causes the screen processing unit 103 to correct output timings of latent images to be formed in the photoreceptor drums 21 by converting the respective color-component image data (image information) based on the received color-shift correction amounts (S251=>S253). After again storing the converted color-component image data in the memory 102, the control unit 105 sends the stored image data, for which the output-timing correction has been performed, to the exposing unit 25 via the pulse width modulation processing unit 104 (S253=>S254).

Thus, this exemplary embodiment is different from the exemplary embodiment 1 in that the first color-shift correction process and the second color-shift correction process corrects the output timings by converting image information to perform the color-shift corrections.

In this exemplary embodiment, both of the first color-shift correction process and the second color-shift correction process correct the output timings by converting the image information. Alternatively, in the exemplary embodiment 2, the first color-shift correction process may correct the conveyance speed of the recording material while the second color-shift correction process may correct the output timings by converting the image information in place of correcting the image-formation start timings.

Exemplary Embodiment 4

Figure 26:
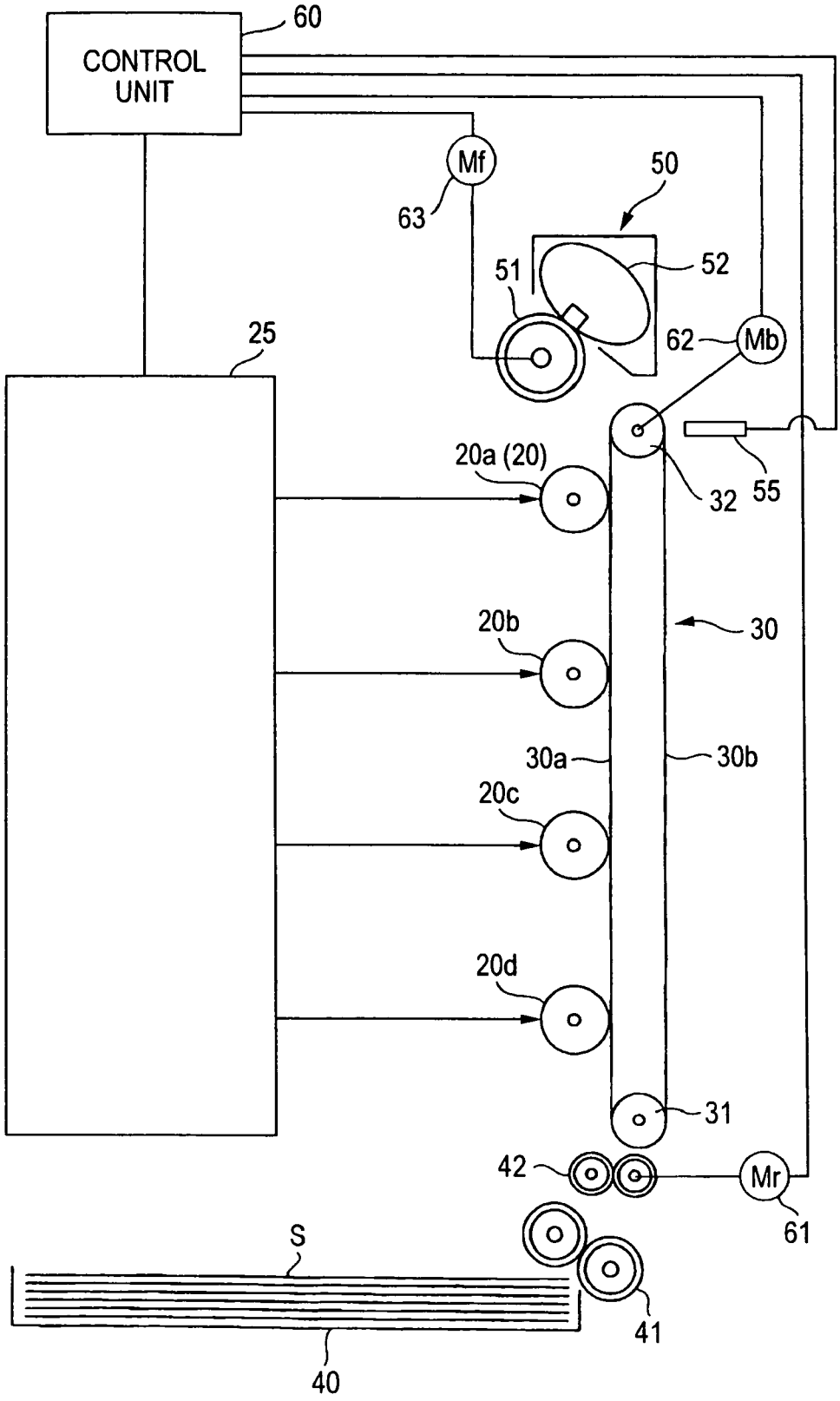
FIG. 26 is an explanatory drawing which schematically illustrates a color image forming apparatus according to an exemplary embodiment 4.

FIG. 26 is an explanatory drawing which schematically illustrates a color image forming apparatus according an exemplary embodiment 4.

In the figure, the basic configuration of the color image forming apparatus of this exemplary embodiment is substantially similar to that of the exemplary embodiment 1. The color image forming apparatus of this exemplary embodiment is different from that of the exemplary embodiment 1 in that the color shift detector 55 detects color-shift detection images TG, which are formed on a recording material S and which are fused by the fixing device 50. It is noted that similar reference numerals will be given to similar elements to those of the exemplary embodiment 1 and detailed description thereon will be omitted here.

In this exemplary embodiment, the drive motor 63 for driving the fixing device 50 can rotate forward and backward. The fixing device 50 of this exemplary embodiment can convey a recording material S, for which a fixing process is performed, in an opposite direction to the normal conveyance direction. The fixing device 50 and the recording-recording material conveyance belt 30 can invert the recording material S, for which the fixing process is performed, as described later.

In addition, in this exemplary embodiment, while the color shift detector 55 is provided in a location where the color shift detector 55 faces the tension roller 32 of the recording-material conveyance belt 30. Different from the exemplary embodiment 1, in this exemplary embodiment, the color shift detector 55 is disposed to face a rear-side recording-material conveyance surface 30*b* of the recording-material conveyance belt 30 which is different from a recording-material conveyance surface 30*a* which faces the image forming units 20 (20*a* to 20*d*).

Figure 27:
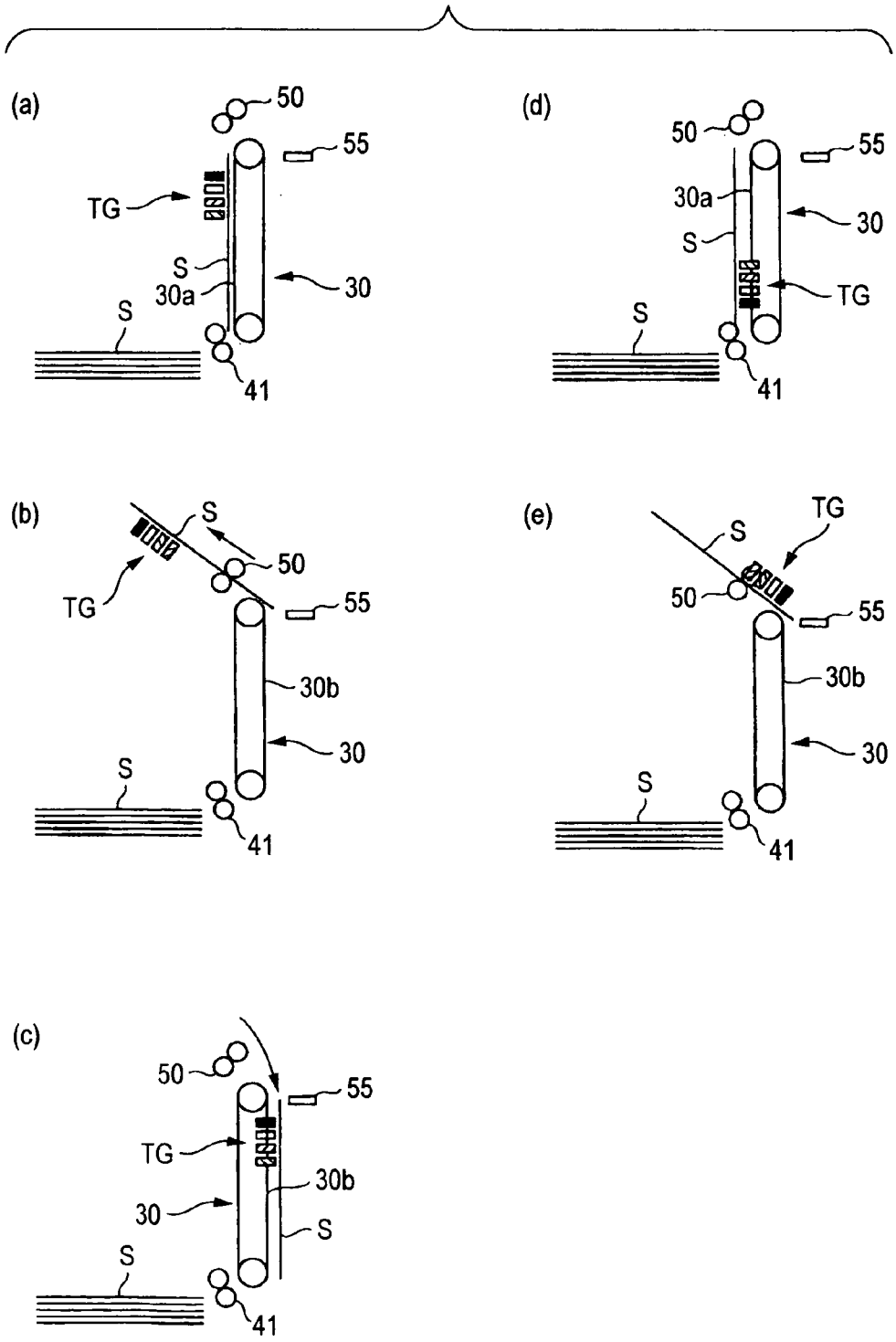
FIGS. 27(*a*) to 27(*e*) are explanatory drawings which show a process of detecting a color-shift detection pattern during the first color-shift correction process in the color image forming apparatus according to the exemplary embodiment 4.

In this exemplary embodiment, the first color-shift correction process detects color-shift detection images (a color-shift detection pattern) TG formed on a recording material S by the color shift detector 55. Before detecting of the color-shift detection images TG, for example, the following process are performed. That is, the color-shift detection images TG are formed on the recording material S as shown in FIG. 27(*a*). As shown in FIG. 27(*b*), the color-shift detection images TG formed on the recording material S are fixed by the fixing device 50. Thereafter, as shown in FIG. 27(*c*), a fusing roller of the fixing device 50 is rotated reversely, so as to return the recording material S for which the fixing process is performed to a registration-roller side of the recording-material conveyance belt 30 by using the rear-side recording-material conveyance surface 30*b* of the recording-material conveyance belt 30. Furthermore, as shown in FIG. 27(*d*), the inverted recording material S is conveyed by the front-side recording-material conveyance surface 30*a* of the recording-material conveyance belt 30. As shown in FIG. 27(*e*), the recording material S is conveyed reversely again by the fixing device 50. Thereby, the color-shift detection images TG fixed onto the recording material S are detected by the color shift detector 55.

Thereafter, the control unit 60 determines color-shift correction amounts based on a result of detecting of the color-shift detection images TG and performs a similar color-shift correction process to that of the exemplary embodiment 1.

The recording material S on which the color-shift detection images TG are formed is discharged and accommodated in a discharging/receiving tray (not shown) through the fixing device 50.

In particular, in this exemplary embodiment, since the color-shift detection images TG which have been fixed by the fixing device 50 are used, a color-shift detection can be performed while being less affected by waste heat from the fixing device 50 and being less affected by electric noise.

Figure 28:
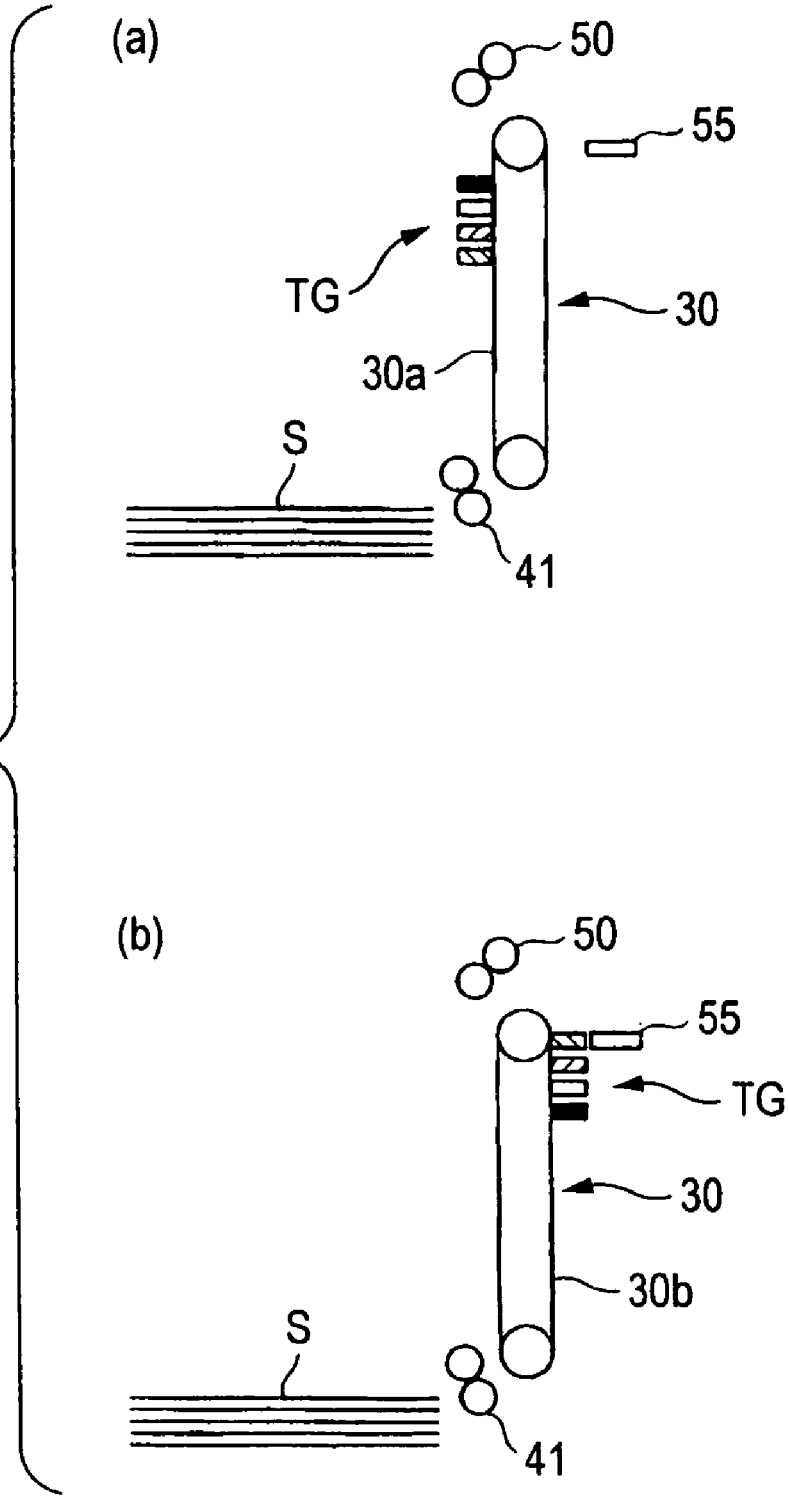
FIGS. 28(*a*) and 28(*b*) are explanatory drawings which show a process of detecting a color-shift detection pattern during the second color-shift correction process in the color image forming apparatus according to the exemplary embodiment 4.

In the second color-shift correction process, as shown in FIGS. 28(*a*), (*b*), color-shift detection images (a color-shift detection pattern) TG may be formed on the recording-material conveyance belt 30 and may be detected by the color shift detector 55 when the color-shift detection images TG are moved from the front-side recording-material conveyance surface 30*a* to the rear-side recording-material conveyance surface 30*b*.

In addition, the color-shift detection images TG are cleaned by the belt cleaner 35 when the detecting operation has been completed.

Exemplary Embodiment 5

Figure 29:
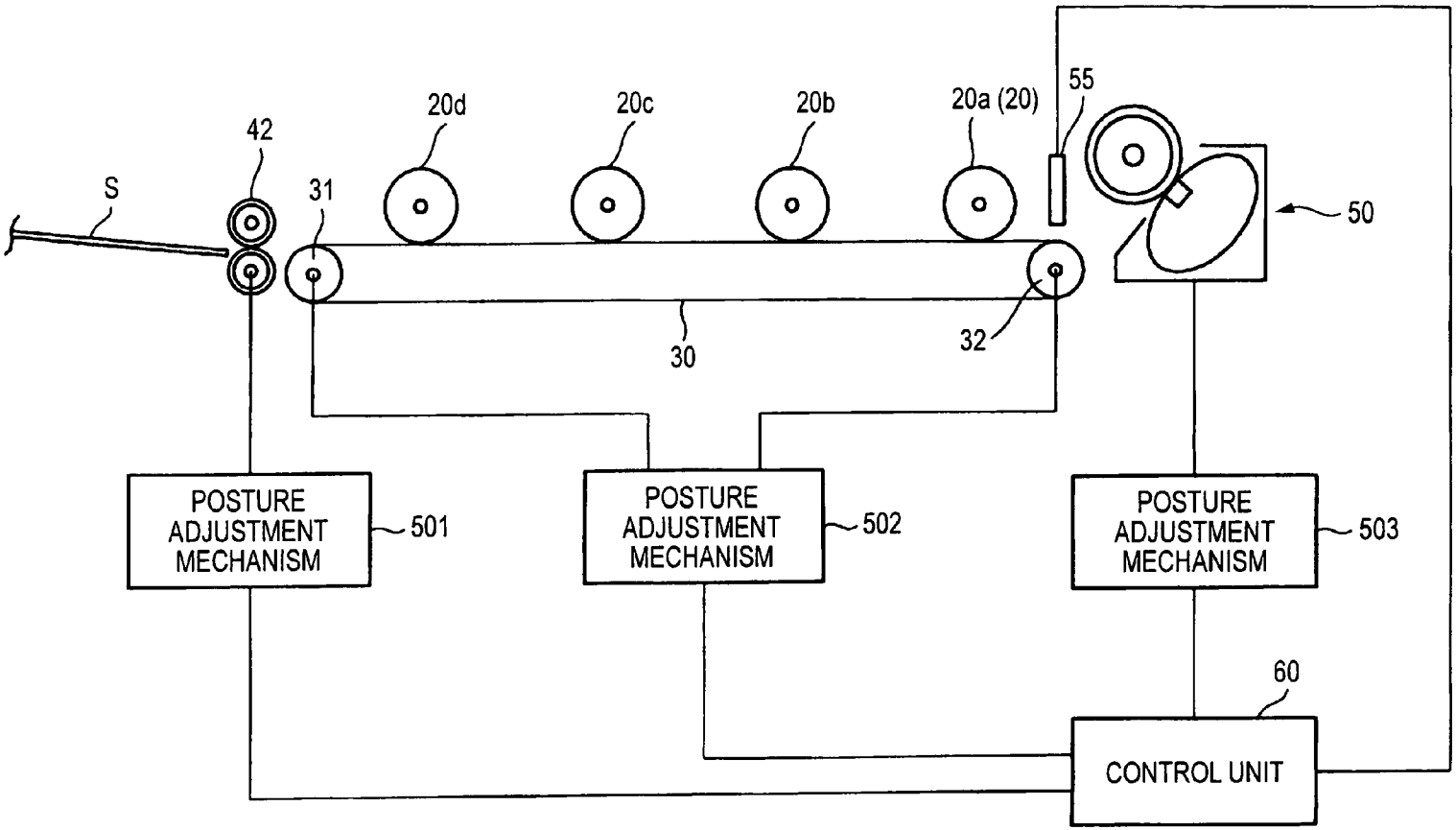
FIG. 29 is an explanatory drawing which schematically illustrates a color image forming apparatus according to an exemplary embodiment 5.

FIG. 29 is an explanatory drawing which schematically illustrates a color image forming apparatus according to an exemplary embodiment 5.

In the figure, the color image forming apparatus is configured so that posture adjustment mechanisms 501 to 503 for adjusting mounting postures or setting postures of the recording-material conveyance belt 30 (which may serve as a first conveyance member), the registration roller 42 and the fixing device 50 (which may serve as a second conveyance member) are provided, respectively. The control unit 60 sends a predetermined control signal (first color-shift correction amounts, second color-shift correction amounts) to the posture adjustment mechanisms 501 to 503 based on color-shift detection information detected by the color shift detector 55. The selected posture adjustment mechanisms 501 to 503 perform color-shift corrections.

Here, a correction target in the first color-shift correction and a correction target in the second color-shift correction may be selected appropriately from among (1) the setting angle of the recording-material conveyance belt 30, (2) the mounting angle of the registration roller 42 or the fixing device 50 and (3) the contact pressure of the registration roll 42.

In this exemplary embodiment, the correction targets of the first color-shift correction and the second color-shift correction are a mechanical adjustment amount of the first conveyance unit and/or a mechanical adjustment amount of the second conveyance unit. Alternatively, as described in the exemplary embodiments 1 to 4, another correction target such as the image-formation start timings of the respective image forming units 20, the output timings of the respective image forming units 20 by converting the image information or the conveyance speed of the recording material may be combined with the mechanical adjustment amount appropriately.

(FIG. 1)
5. color-shift-detection-image forming unit
7. recording-material color-shift correcting unit
8. conveyance-unit color-shift correcting unit.

(FIG. 2)
A. Recording material color-shift correction
B. Transfer unit color-shift correction
C. before correction
D. after correction
E. reference pattern (FIG. 5)
A. Color-shift correction process
B. Has a first color-shift correction been completed?
C. Perform the first color-shift correction
D. Has a second color-shift correction been completed?
E. Perform the second color-shift correction
F. Is it a timing to perform the first color-shift correction?

(FIG. 6)
A. First color-shift correction process
B. Form a main-scanning color-shift detection image and a sub-scanning color-shift detection image on a recording material
C. Read the color-shift detection images by a color shift detector
D. Calculate a color-shift amount in the main scanning direction and a color-shift amount in the sub-scanning direction
E. Determine the color-shift correction amount in the main scanning direction and the color-shift correction amount in the sub-scanning direction
F. Correct output timings by converting image information based on the color-shift correction amounts
G. Correct image-formation start timings based on the color-shift correction amounts
H. Correct a conveyance speed of the recording material based on the color-shift correction amounts.

(FIG. 7)
A. Second color-shift correction process
B. Form a main-scanning color-shift detection image and a sub-scanning color-shift detection image on a recording-material conveyance belt
C. Read the color-shift detection images by the color shift detector
D. Calculate a color-shift amount in the main scanning direction and a color-shift amount in the sub-scanning direction using a result of the first color-shift correction process as a reference
E. Determine a color-shift correction amount in the main scanning direction and a color-shift correction amount in the sub-scanning direction
F. Correct output timings by converting image information based on the color-shift correction amounts
G. Correct image-formation start timings based on the color-shift correction amounts (FIG. 11)
A. Position in Recording Material
B. Registration-error amount in a main scanning direction (FIG. 12)
A. Position in Recording Material
B. Registration-error amount in a sub-scanning direction (FIG. 13)
A. Ideal state
B. Transfer positions of respective colors transfer
C. skew state (FIG. 14)
A. No shift
B. Shift towards a negative side
C. Shift towards a positive side
D. Shift in the sub-scanning direction
E. Shift in the main scanning direction (FIG. 15)
A. TG (sub)
B. Detection output
C. Reference voltage
D. On the belt
E. On the recording material
F. Comparison voltage (FIG. 16)
A. TG (main)
B. Detection output
C. Reference voltage
D. On the belt
E. On the recording material
F. Comparison voltage (FIG. 17)
A./SOS signal
B./VSYNC signal (Y)
C./VSYNC signal (M)
D./VSYNC signal (C)
E./VSYNC signal (K)
F. Image formation timings before color-shift correction in the sub-scanning direction is performed
G. Image formation timings after color-shift correction in the sub-scanning direction is performed (FIG. 18)
A. Relationship among beams of an exposing unit corresponding to respective colors
B./SOS signal
C./VIDEO signal (Y)
D./VIDEO signal (M)
E./VIDEO signal (C)
F./VIDEO signal (K)
G. Image formation timings before color-shift correction in the main scanning direction is performed
H. Image formation timings after color-shift correction in the main scanning direction is performed (FIG. 20)
A. Correction of a conveyance speed of a recording material conveyance speed in the first color-shift correction process
B. Check color-shift correction amounts in a recording area $A_1$
C. Correct a conveyance speed of a registration roller
D. Check color-shift correction amounts in a recording area $A_3$
E. Correct a conveyance speed of a fixing device.

(FIG. 21)
A. Color-shift amount
B. Speed ratio between registration roller and recording-material conveyance belt
C. Speed ration between fixing device and recording-material conveyance belt (FIG. 22)
A. Color-shift in the main scanning direction
B. Position in a recording material
C. A registration-error amount in the main scanning direction
D. Color-shift amount in the sub-scanning direction
E. A registration-error amount in the sub-scanning direction (FIG. 23)
A. original image data
100. controller
101. color conversion unit
102. memory
103. screen processing unit
104. PWM processing unit
105. control unit
B. image forming apparatus
60. control unit (FIG. 24)
A. Original image
B. Stored image data after the screen processing unit 103 corrects output timings by converting image information correction of output timings of image information by conversion in screen processing unit;
C. With correction of output timings by converting image information
D. Output image of the image forming apparatus
E. Correction in the main scanning direction
F. Without correction of output timings by converting image information (FIG. 25)
A. Original image
B. Stored image data after the screen processing unit 103 corrects output timings by converting image information correction of output timings of image information by conversion in screen processing unit;
C. With correction of output timings by converting image information
D. Output image of the image forming apparatus
E. Correction in the sub-scanning direction
F. Without correction of output timings by converting image information (FIG. 29)
60. control unit
501, 502, 503 posture adjustment mechanism

What is claimed is:

1. A color image forming apparatus comprising:
a plurality of image forming units that form a plurality of color-component images;
a recording material conveyance unit that conveys a recording material to locations corresponding to the respective image forming units;
a color-shift-detection-image forming unit that selectively forms a color-shift detection image on the recording material or the recording material conveyance unit at the respective image forming units;
a color-shift detector for detecting a color shift based on the color-shift detection image, which is selectively formed on the recording material or the recording material conveyance unit by the color-shift-detection-image forming unit;
a recording-material color-shift correcting unit that corrects a color-shift based on color-shift detection information on the recording material detected by the color shift detector; and
a conveyance-unit color-shift correcting unit that performs based on the color-shift detection information on the recording material conveyance unit detected by the color-shift detector after the color-shift correction by the recording-material color-shift correction unit as a reference, color-shift correction based on an amount of change of subsequent color-shift detection information on the recording material conveyance unit, which is obtained by the color-shift detector from the reference.

2. The color image forming apparatus according to claim 1, wherein the recording-material color-shift correcting unit performs the color-shift correction based on the color-shift detection information detected according to positions on the recording material.

3. The color image forming apparatus according to claim 1, wherein:
the recording-material color-shift correcting unit detects a fixed image which has passed through a fixing device disposed on a downstream side of the recording material conveyance unit in a recording-material conveyance direction, and performs the color-shift correction based on the color-shift detection information.

4. The color image forming apparatus according to claim 1, wherein the conveyance-unit color-shift correcting unit performs the color-shift correction in accordance with a condition under which a use environment is changed.

5. The color image forming apparatus according to claim 1, wherein each of the recording-material color-shift correcting unit and the conveyance-unit color-shift correcting unit performs the color-shift correction in accordance with a condition under which a use environment is changed.

6. The color image forming apparatus according to claim 1, wherein:
the recording-material color-shift correcting unit performs the color-shift correction at an initial stage, and
the conveyance-unit color-shift correcting unit performs second and subsequent color-shift corrections using a result of the color-shift correction performed by the recording-material color-shift correcting unit.

7. A color image forming apparatus comprising:

a plurality of image forming units that form a plurality of color-component images;

a recording material conveyance unit that conveys a recording material to locations corresponding to the respective image forming units;

a color-shift-detection-image forming unit that selectively forms a color-shift detection image on the recording material or the recording material conveyance unit at the respective image forming units;

a color-shift detector for detecting a color-shift based on the color-shift detection image, which is selectively formed on the recording material or the recording material conveyance unit by the color-shift-detection-image forming unit;

a recording-material color-shift correcting unit that corrects image-formation start timings of the respective image forming units based on the color-shift detection information on the recording material detected by the color-shift detector, to perform a color-shift correction, and a conveyance-unit color-shift correcting unit that corrects, based on the color-shift detection information on the recording material conveyance unit detected by the color-shift detector after the color-shift correction by the recording-material color-shift correction unit as a reference, the image-formation start timings of the respective image forming units based on an amount of change in subsequent color-shift detection information on the recording material conveyance unit detected by the color-shift detector from the reference, to perform the color-shift correction.

8. A color image forming apparatus comprising:

a plurality of image forming units that forms a plurality of color-component images;

a recording material conveyance unit that conveys a recording material to locations corresponding to the respective image forming units;

a color-shift-detection-image forming unit that selectively forms a color-shift detection image on the recording material or the recording material conveyance unit at the respective image forming units;

a color-shift detector for detecting a color shift-based on the color-shift detection image formed selectively on the recording material or the recording material conveyance unit by the color-shift-detection-image forming unit;

a recording-material color-shift correcting unit that corrects output timings of latent images to be formed in the respective image forming units based on the color-shift detection information on the recording material detected by the color-shift detector, to perform a color-shift correction, and a conveyance-unit color-shift correcting unit that corrects, based on the color-shift detection information on the recording material conveyance unit detected by the color-shift detector after the color-shift correction by the recording-material color-shift correcting unit as a reference, the output timings of the latent images to be formed in the respective image forming units based on an amount of change in subsequent color-shift detection information on the recording material conveyance unit detected by the color-shift detector from the reference, to perform the color-shift correction.

9. A color image forming apparatus comprising:

a plurality of image forming units that forms a plurality of color-component images;

a recording material conveyance unit for conveys a recording material to locations corresponding to the respective image forming units;

a color-shift-detection-image forming unit that selectively forms a color-shift detection image on the recording material or the recording material conveyance unit at the respective image forming units;

a color-shift detector for detecting a color-shift based on the color-shift detection image formed selectively on the recording material or the recording material conveyance unit by the color-shift-detection-image forming unit;

a recording-material color-shift correcting unit that corrects a conveyance speed of the recording material based on the color-shift detection information on the recording material detected by the color-shift detector, to perform a color-shift correction, and a conveyance-unit color-shift correcting unit that corrects, based on the color-shift detection information on the recording material conveyance unit detected by the color-shift detector after the color-shift correction by the recording-material color-shift correcting unit as a reference, image-formation start timings of the respective image forming units or output timings of latent images to be formed in the respective image forming units based on an amount of change of subsequent color-shift detection information on the recording material conveyance unit detected by the color-shift detector, to perform the color-shift correction.

10. The color image forming apparatus according to claim 9, wherein:

the recording-material color-shift correcting unit corrects the conveyance speed of the recording material by a conveyance member disposed on an upstream side of the recording material conveyance unit in a recording material conveyance direction.

11. The color image forming apparatus according to claim 9, wherein:

the recording-material color-shift correcting unit corrects the conveyance speed of the recording material by a fixing device disposed on a downstream side of the recording material conveyance unit in a recording-material conveyance direction.

12. A color image forming apparatus comprising:

a plurality of image forming units that form a plurality of color-component images;

a recording material conveyance unit for conveying a recording material to locations corresponding to the respective image forming units;

a color-shift-detection-image forming unit that selectively forms a color-shift detection image on the recording material or the recording material conveyance unit at the respective image forming units;

a color-shift detector for detecting a color-shift based on the color-shift detection image formed selectively on the recording material or the recording material conveyance unit by the color-shift-detection-image forming unit;

a recording-material color-shift correcting unit that corrects a mechanical adjustment amount of a recording material conveyance member based on the color-shift detection information on the recording material detected by the color-shift detector, to perform the color-shift correction, and a conveyance-unit color-shift correcting unit that corrects, based on the color-shift detection information on the recording material conveyance unit detected by the color-shift detector after the color-shift correction by the recording-material color-shift correcting unit as a reference, the mechanical adjustment amount of the recording material conveyance member based on an amount of change of the subsequent color-shift detection information on the recording material conveyance unit detected by the color-shift detector from the reference, to perform the color-shift correction.

* * * * *